US006784622B2

(12) United States Patent
Newman, Jr. et al.

(10) Patent No.: US 6,784,622 B2
(45) Date of Patent: Aug. 31, 2004

(54) SINGLE SWITCH ELECTRONIC DIMMING BALLAST

(75) Inventors: Robert C. Newman, Jr., Emmaus, PA (US); Mark Taipale, Harleysville, PA (US); Joel S. Spira, Coopersburg, PA (US)

(73) Assignee: Lutron Electronics Company, Inc., Coopersburg, PA (US)

( * ) Notice: Subject to any disclaimer, the term of this patent is extended or adjusted under 35 U.S.C. 154(b) by 0 days.

(21) Appl. No.: 10/006,036

(22) Filed: Dec. 5, 2001

(65) Prior Publication Data

US 2003/0107332 A1 Jun. 12, 2003

(51) Int. Cl.[7] ..... H05B 37/00; G05F 1/00

(52) U.S. Cl. ..... 315/219; 315/307

(58) Field of Search ..... 315/219, 244, 315/246, 247, 209 R, 307, DIG. 4, DIG. 5, 272

(56) References Cited

U.S. PATENT DOCUMENTS

| | | | | |
|---|---|---|---|---|
| 4,663,570 A | | 5/1987 | Luchaco et al. | 315/219 |
| 5,363,020 A | * | 11/1994 | Chen et al. | 315/209 R |
| 5,387,847 A | | 2/1995 | Wood | 315/209 R |
| 5,399,944 A | | 3/1995 | Konopka et al. | 315/219 |
| 5,416,387 A | * | 5/1995 | Cuk et al. | 315/209 R |
| 5,517,086 A | | 5/1996 | El-Hamamsy et al. | 315/247 |
| 5,608,292 A | * | 3/1997 | Konopka et al. | 315/209 R |
| 5,694,006 A | * | 12/1997 | Konopka | 315/219 |
| 5,804,926 A | | 9/1998 | Deavenport | 315/219 |
| 5,869,937 A | * | 2/1999 | Konopka | 315/291 |
| 5,872,430 A | | 2/1999 | Konopka | 315/219 |
| 5,994,847 A | * | 11/1999 | Konopka | 315/209 R |
| 6,061,259 A | | 5/2000 | DeMichele | 363/125 |
| 6,141,230 A | | 10/2000 | Sum | 363/61 |
| 6,452,343 B2 | * | 9/2002 | Qostvogels et al. | 315/272 |

OTHER PUBLICATIONS

"Fluorescent Ballast Design Using Passive P.F.C. and Crest Factor Control" by Peter N. Wood, International Rectifier Corporation 1998.

"Single–Switch Frequency–Controlled Electronic Dimming Ballast with Unity Power Factor", Chang–Shiarn Lin et al., IEEE Transactions on Aerospace and Electronic Systems, vol. 36, No. 3, pp. 1001–1006, Jul., 2000.

"Single–Stage High Power–Factor Electronic Ballast" M. Marx et al., PEMC.

"Ripple–Free, Single–Stage Electronic Ballasts with Dither–Booster Power Factor Corrector" T.F. Wu et al., IEEE Industry Applications Society, pp. 2372–2379, Jan., 1997.

"High Power Factor Correction Circuit Using Valley Charge–Pumping for Low Cost Electronic Ballasts" G. Chae et al., IEEE, pp. 2003–2008, Aug., 1998.

(List continued on next page.)

*Primary Examiner*—Wilson Lee
*Assistant Examiner*—Minh Dieu
(74) *Attorney, Agent, or Firm*—Ostrolenk, Faber, Gerb & Soffen, LLP

(57) ABSTRACT

An electronic ballast for driving at least one gas discharge lamp from a source of AC power which has a substantially sinusoidal line voltage at a given line frequency includes a rectifying circuit; a valley fill circuit; and an inverter circuit connectable to the at least one gas discharge lamp; The inverter circuit has a single controllably conductive device and an inductor; the inductor connectable to the at least one gas discharge lamp; the inverter circuit being adapted to draw current from the source of AC power whereby the total current drawn from the source of AC power has a total harmonic distortion below about 33.3%; and whereby the lamp current crest factor below about 2.1.

56 Claims, 15 Drawing Sheets

OTHER PUBLICATIONS

"A Unity Power Factor Electronic Ballast for Fluorescent Lamp Having Improved Valley Fill and Valley Boost Converter", Y. Youn et al., PESC97 Record IEEE, pp. 53–59, May, 1997.

"Modified Valley Fill High Power Factor Electronic Ballast For Compact Fluorescent Lamps".
Mustansir H. Kheraluwala, Sayed Amr El–Hamamsy G.E. R&D 1995 IEEE pp. 10–14.

"Mosfet Switch Provides Efficient ac/dc Conversion" Spehro Pephany, Design Ideas XP–000966357.

"Evaluation of a Novel Single–Stage High–Power–Factor Electronic Ballast Based on Integrated Buck Half–Bridge Resonant Inverter" J.M. Alonso, A.J. Calleja, J.Ribas,. E. Corominas and M. Rico–Secades—Universidad de Oviedo, DIEECS—Technology Electronica—2000 IEEE—pp. 610–616.

"A New Discharge Lamp Ballast Based on a Self–Oscillating Full–Bridge Inverter Integrated with a Buck Type PFC Circuit"—J.Ribas, J.M. Alonso, A.J. Calleja, E.L. Corominas,.

M. Rico–Secades—Universidad de Oviedo—dpto. De Ingenieria Electrica y Electronica Technologia Electronica—2001 IEEE pp. 688–694.

* cited by examiner

SINGLE SWITCH ELECTRONIC DIMMING BALLAST

RELATED APPLICATIONS

This application is related to co-pending application Ser. No. 10/006,021, filed Dec. 5, 2001, entitled ELECTRONIC BALLAST (P/10-582) and assigned to the assignee of the present application, the entire disclosure of which is hereby incorporated by reference.

FIELD OF THE INVENTION

The present invention relates to the general subject of electronic ballasts for fluorescent lamps and more particularly to a single switch inverter based electronic ballast.

BACKGROUND OF THE INVENTION

Electronic ballasts for fluorescent and other gas discharge lamps are well known. Electronic ballasts operate at much higher frequencies and are more energy efficient than conventional line frequency ballasts. Electronic ballasts can reduce the energy consumption of a lighting system by more than 20%. Higher frequency operation provides for the same amount of light at a lower input power.

Electronic ballasts having a dimming function are also well known. Dimming, in combination with the energy efficient characteristics of high frequency operation of the lamp, can result in further energy savings.

Although the energy efficient characteristics of electronic ballasts are attractive, their production cost affects the commercialization of electronic dimming ballasts. A major factor contributing to the cost of producing electronic ballasts is the number of parts required for the ballast. Line frequency ballasts require fewer parts and, therefore, are less costly to produce.

In addition, since line frequency ballasts have been known for over fifty years, they are highly optimized and exhibit fewer problems affecting their performance and reliability. Electronic ballasts on the other hand, with their greater number of parts, exhibit more performance problems. Further, having a greater number of parts means that the electronic ballast is more susceptible to failure.

Many known electronic ballasts use two or more power semiconductor switching devices in their inverter circuits. These switching devices dissipate a significant amount of heat in operation, which may adversely affect the reliability of the ballast and generally require heat sinking to the ballast enclosure. In addition, power semiconductor switching devices are expensive, and thus significantly add to the total cost of the ballast.

A typical topology for a conventional electronic ballast uses a half bridge inverter circuit containing two semiconductor switching devices such is two metal oxide semiconductor field effect transistors (MOSFET). Such a circuit is described in above noted co-pending application Ser. No. 10/006,021. The top switch in this conventional configuration requires a high-side driver circuit because it's control terminal is not referenced to the circuit common. The high side driver may be a transformer or an integrated circuit such as IR2111 chip driver sold by the International Rectifier Corporation of El Segundo, Calif. In addition to the high side driver, the half bridge circuits in conventional pulse width modulated (PWM) electronic ballasts also require blocking diodes and fast recovery free wheeling diodes to prevent the conduction of the intrinsic body in the switches.

Other prior art electronic ballasts can additionally include active power factor correction circuits to improve ballast input current total harmonic distortion. Active power factor correction circuits are often implemented with a boost converter type circuit. An example of a ballast employing a boost converter is described in "Single-Switch Frequency-Controlled Electronic Dimming Ballast With Unity Power Factor," Chang-Shiarn Lin et al., IEEE Transactions on Aerospace and Electronic Systems, pages 1001–1006, July 2000.

An additional disadvantage of prior art ballasts is a characteristic in-rush of current into the ballast when AC power is applied to the ballast. Typical ballasts include a large storage capacitor which is charged when AC power is applied to the ballast. The current to charge this storage capacitor can be many times larger than the typical nominal input current of the electronic ballast. This large in-rush of current can cause damage to the equipment energizing the electronic ballast. In order to avoid this large in-rush of current, many ballasts include additional circuitry to limit this current. This additional circuit increases the cost and complexity of the ballast. It would be advantageous to have a ballast that inherently limits the in-rush current without additional circuitry whose sole function is to limit in-rush current.

It would be desirable to have an electronic ballast circuit that contains fewer parts to reduce cost and increase reliability.

An important indicator of lamp current quality for a gas discharge lamp such as a fluorescent lamp is the current crest factor (CCF) of the lamp current, which is defined as the peak to RMS (root mean square) ratio of the lamp current.

$$CCF = \frac{I_{PK}}{I_{RMS}} \qquad \text{(Equation 1)}$$

A low CCF is preferred because a high CCF can cause the deterioration of the lamp filaments which would subsequently reduce the life of the lamp. A CCF of 2.1 or less is recommended by Japanese Industrial Standard (JIS) JIS C 8117-1992, and a CCF of 1.7 or less is recommended by the International Electrotechnical Commission (IEC) Standard 921-1988-07.

In an AC power system, the voltage or current wave shapes may be expressed as a fundamental and a series of harmonics. These harmonics have some multiple frequency of the fundamental frequency of the line voltage or current. Specifically, the distortion in the AC wave shape has components which are integer multiples of the fundamental frequency. Of particular concern are the harmonics that are multiples of the $3^{rd}$ harmonic. These harmonics add numerically in the neutral conductor of a three phase power system. Total harmonic distortion (THD) of the ballast input current is preferred to be below 33.3% to prevent overheating of the neutral wire in a three phase power system. Further, many users of lighting systems require ballasts to have a ballast input current total harmonic distortion of less than 20%.

It is also desirable to reduce or eliminate the very high frequency harmonics of the output waveform of the electronic ballast in order to reduce the electromagnetic interference (EMI) emissions of the ballast.

SUMMARY OF THE INVENTION

In accordance with a first feature of the invention, an electronic ballast for driving a gas discharge lamp includes a rectifier to convert an AC line input voltage to a rectified voltage, a valley fill circuit including an energy storage device such as a capacitor, the energy in this device being used to fill the valleys between successive rectified voltage peaks to produce a valley filled voltage, and an inverter circuit having a single controllably conductive device to convert the valley filled voltage to a high-frequency AC voltage. The energy storage device can be a capacitor or an inductor or any other energy storage component or combination of components. Charging the energy storage device refers to increasing the energy stored in the energy storage device. A controllably conductive device is a device whose conduction can be controlled by an external signal. These include devices such as metal oxide semi-conductor field effect transistors (MOSFETs), insulated gate bi-polar transistors (IGBTs), bi-polar junction transistors (BJTs), triacs, SCRs, relays, switches, vacuum tubes and other switching devices. The high frequency AC voltage is used for driving a current through a gas discharge lamp. A control circuit controls the conduction of the controllably conductive device in a novel way to deliver a desired lamp current to the gas discharge lamp and draw an input ballast current with a reduced total harmonic distortion. The electronic ballast of the invention described can drive more than one gas discharge lamp.

According to an additional aspect of the ballast of the present invention, the inverter circuit includes a single controllably conductive device such as a power MOSFET. The power MOSFET may be connected to the second winding of a transformer. The conduction of the MOSFET alternately connects and disconnects the second winding of the transformer to the output of the valley fill circuit. A suitable control circuit is used to control the controllably conductive device.

Still another aspect of the invention involves the coupling of a first winding with the second winding of the transformer. When the second winding is connected to the valley fill circuit via the single controllably conductive device, the first winding is disconnected from the valley fill circuit by a reverse biased diode. When the single controllably conductive device is in the non-conducting state, some of the energy stored in the magnetizing inductance of the transformer is transferred to the load via the first winding or a third winding, and some of the energy is transferred to a capacitor of the valley fill circuit so as to recharge this valley fill capacitor. This transfer of energy to the valley fill capacitor has two purposes. First, the capacitor is recharged for use during the valley of the rectified line voltage. Second, the capacitor establishes a fixed voltage across the first winding. The capacitor is adequately large with respect to the high frequency operation of the inverter such that its average voltage does not change significantly during a single high frequency cycle. This, in a high frequency sense, makes the capacitor look like a voltage source to the first winding. This in turn establishes a fixed voltage on the second winding via the turns ratio between the first winding and the second winding. Setting this predetermined voltage on the second winding of the transformer establishes the off-state voltage stress applied to the single controllably conductive device.

A yet further aspect of the invention involves using a valley fill circuit to prevent the voltage supplied to the inverter circuit from dropping to zero when the rectified input line voltage reaches a minimum value. The valley fill circuit comprises an energy storage device such as a capacitor. The valley fill circuit capacitor does not charge from the rectified line directly; rather, it charges indirectly via a tap on the first winding of the transformer. The capacitor is prevented from discharging into the first winding by a diode. A current limiting resistor may be employed to limit the amount of current that flows from the first winding into the valley fill capacitor.

Another aspect of the ballast is the operation of the control circuit used to control the controllably conductive device. The control circuit reduces the conduction time of the controllably conductive device at the time near the peak of the AC line voltage, and thereby reducing the current crest factor of the lamp current from that which would normally have occurred.

Still another aspect of the invention involves a current drawing circuit to supplement the ballast input current in order to increase the length of time during which current may be drawn from the AC line to improve ballast input current total harmonic distortion. The current drawing circuit may be a cat ear circuit which draws current during a predetermined period, for example, at the beginning and end (or one of them) of an AC line voltage half cycle. The cat ear circuit may also be used to provide power for the control circuit of the inverter circuit.

Still another aspect of the ballast of the invention includes a coupling impedance that connects the inverter circuit to a gas discharge lamp. Typically this impedance is an inductor or a tank circuit. The operation of the controllably conductive device causes the inverter transformer to supply a high frequency AC voltage which is applied to the connected lamp through the coupling impedance. The impedance reduces the harmonic content of the output current thereby reducing the EMI emissions of the ballast.

An electronic ballast according to the present invention includes fewer parts and is, thus, more reliable and less costly, has a low CCF of 2.1 or lower, preferably 1.7 or lower; has a low THD of 33.3% or lower, preferably 20% or lower; and has reduced EMI emissions. These and other advantageous aspects of the present invention will be explained in detail below with reference to the drawings.

DETAILED DESCRIPTION OF EMBODIMENTS OF THE INVENTION

Figure 1:
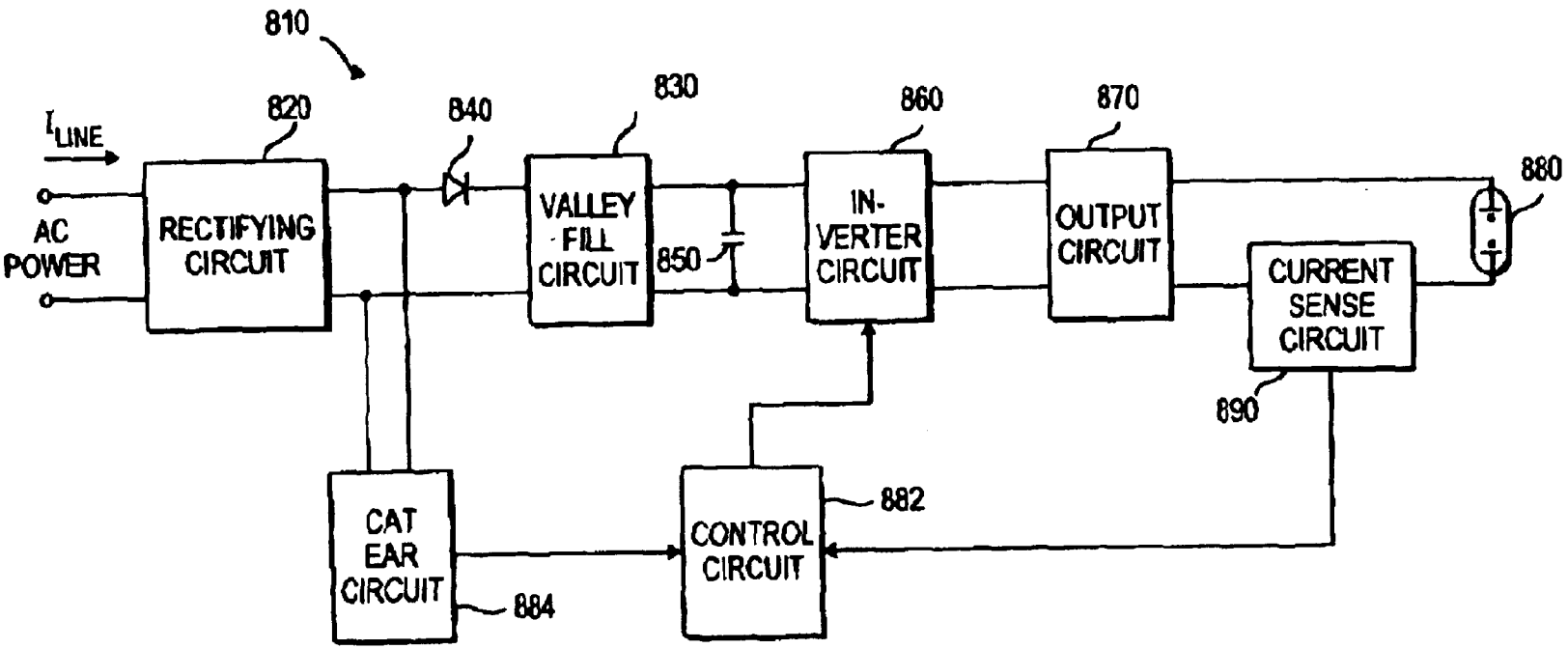
FIG. 1 is a simplified block diagram of a single switch ballast circuit according to an embodiment of the present invention.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Ballast Overview

Referring first to FIG. 1, there is shown a simplified block diagram of an electronic ballast 810 constructed in accordance with the invention. The ballast 810 includes a rectifying circuit 820 capable of being connected to an AC power supply which provides an AC line voltage with a given line frequency. Typically, the given line frequency of the AC power supply is 50 Hz or 60 Hz. However, the invention is not limited to these particular frequencies. The rectifying circuit 820 converts the AC line voltage to provide a full wave rectified voltage. Whenever a device is said to be connected, coupled, coupled in circuit relation, or connectable to another device, it means that the device may be directly connected by a wire or alternately, connected through another deivce such as (but not limited to) a resistor, diode, controllably conductive device, and this connection may be in a series or parallel arrangement. In one embodiment of the invention, rectifying circuit 820 is connected to a valley fill circuit 830, to be described, through a diode 840. The valley fill circuit 830 selectively charges and discharges an energy storage device to be described, so as to create a valley filled voltage. A high frequency bypass capacitor 850 is connected across the output terminals of the valley fill circuit 830. The output terminals of the valley fill circuit 830 are in turn connected to the input terminals of an inverter circuit 860. The inverter circuit 860 converts the valley filled voltage to a high-frequency AC voltage. The output terminals of the inverter circuit 860 are connected to an output circuit 870, which typically includes a resonant tank, or optionally only an inductor, and may also include a coupling transformer. The output circuit 870 filters the inverter circuit 860 output to supply essentially sinusoidal high frequency voltage, as well as provides voltage gain and increased output impedance. The output circuit 870 is capable of being connected to drive a load 880 such as a gas discharge lamp; for example, a fluorescent lamp. An output current sense circuit 890 coupled to the load 880 provides load current feedback to a control circuit 882. The control circuit 882 provides control signals to control the operation of the inverter circuit 860 so as to provide a desired load current to the load 880. A cat ear circuit 884 is connected across the output terminals of the rectifying circuit 820 and provides the necessary power for operation of the control circuit 882.

The Inverter Circuit

Figure 2:
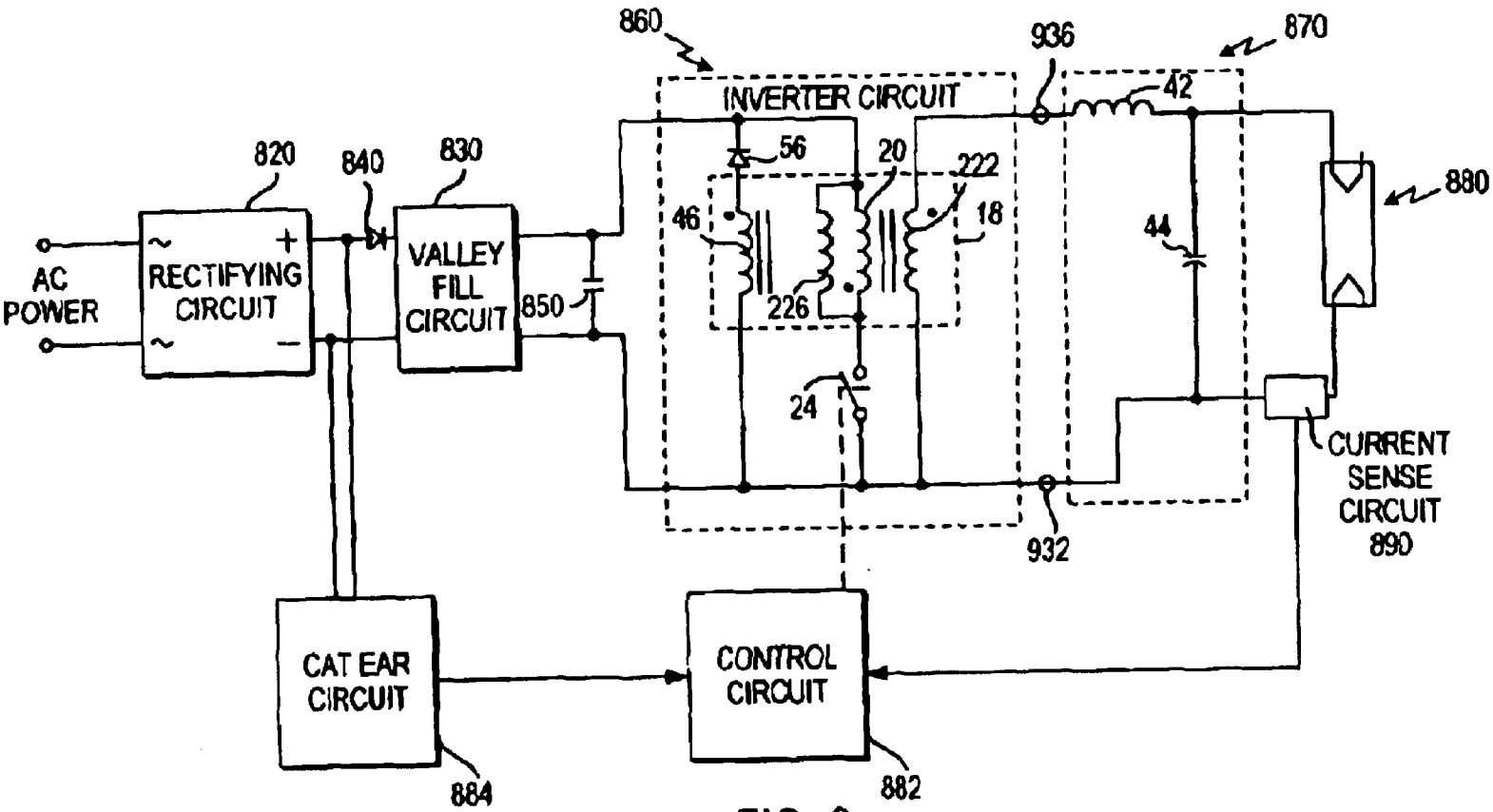
FIG. 2 is a simplified schematic circuit diagram of the single switch inverter according to an embodiment of the present invention.

As can be seen in FIG. 2, the inverter circuit 860 is connected to valley fill circuit 830 which is connected to the rectifying circuit 820. Power is delivered to the inverter circuit 860 through the rectifying circuit 820 and valley fill circuit 830 for the inverter circuit 860 to provide a high-frequency voltage as described below. The inverter circuit 860 converts the voltage provided by the valley fill circuit 830 into a high frequency AC voltage. The inverter circuit 860 includes a transformer 18, controllably conductive device 24, and diode 56. Further, transformer 18 comprises at least 2 windings, and for clarity in FIG. 2 comprises 3 windings, first winding 46, second winding 20 and third winding 222 (a winding 226 is a magnetizing inductance, described below). This conversion from valley filled voltage delivered by the valley fill circuit 830 to a high frequency voltage is enabled by the operation of the controllably conductive device 24 in the inverter circuit 860. The high frequency voltage generated at the output terminals 932, 936 of inverter circuit 860 is applied to output circuit 870 to drive a lamp current through a gas discharge lamp 880.

The operation of the inverter circuit 860 is as follows. The control circuit 882 of FIG. 2 enables the conduction of controllably conductive device 24 of FIG. 2 in the inverter circuit 860. The state of having controllably conductive device 24 conductive will be referred to as a first state. With controllably conductive device 24 conductive, valley filled voltage from the output of valley fill circuit 830 is applied to the second winding 20 of the transformer 18. For clarity, the magnetizing inductance of transformer 18 is shown as a separate winding 226 in FIG. 2, although it is not physically a separate winding. The voltage applied to winding 20 allows current to flow through winding 20 resulting in charging of the magnetizing inductance 226 of transformer 18. Further, with controllably conductive device 24 conductive, the voltage applied to winding 20 is transformed to a third winding 222 by the turns ratio of the windings 20,222. This applies a voltage of a first polarity to output circuit 870. Further, with controllably conductive device 24 conductive, a voltage is transformed to the first winding 46. However, diode 56 will be reverse biased during this state due to the winding convention of transformer 18 as shown by the dot convention. Controllably conductive device 24 will remain in a conductive state until the control circuit 882 commands a change of state based on a closed loop response to the system control variables (described below).

In a second state, the controllably conductive device 24 is commanded by control circuit 882 (FIG. 2) to be non-conductive. When this occurs, current flow through the second winding 20 is disabled. However, current flow through the magnetizing inductance 226 cannot instantly stop flowing. It must conform to the equation of state for an inductor, $V=L\,dI/dt$. This forces the magnetizing inductance 226 to become a voltage source driving transformer 18 in a polarity opposite to that which existed when controllably conductive device 24 was conductive. During this second state, the polarity reversal of the voltage on second winding 20 by the magnetizing inductance 226 drives a like reversal on first and third windings 46,222. With this polarity reversal, third winding 222 drives the output circuit 870 with a voltage of opposite polarity as compared to the first state, when controllably conductive device 24 was conductive, thereby applying a high frequency AC voltage to the output circuit 870. The polarity reversal of the second state now drives first winding 46 with a voltage of polarity capable of forward biasing diode 56. If the voltage on first winding 46 is greater than the valley filled voltage at the output of valley fill circuit 830 then diode 56 will be forward biased. With diode 56 forward biased, the voltage on winding 46 will be limited to the valley filled voltage. This winding 46 therefore acts as a clamp winding for transformer 18. Additionally, during this time when diode 56 is forward biased some of the energy stored in the magnetizing inductance 226 is returned to the high frequency bypass capacitor 850. The limiting of voltage on winding 46 has a corresponding limiting effect on all the windings of transformer 18. The limiting of voltage on second winding 20 of transformer 18 has the advantageous effect of losslessly limiting the voltage stress on controllably conductive device 24 during this second state. The limiting of voltage on third winding 222 has the advantageous effect of applying a well defined voltage to output circuit 870 during this second state. Since the system now returns to the first state after completing the second state, the voltage applied to output circuit 870 is constrained and defined in both states. This operation is believed to be novel in the field of single switch electronic ballasts.

Figure 3:
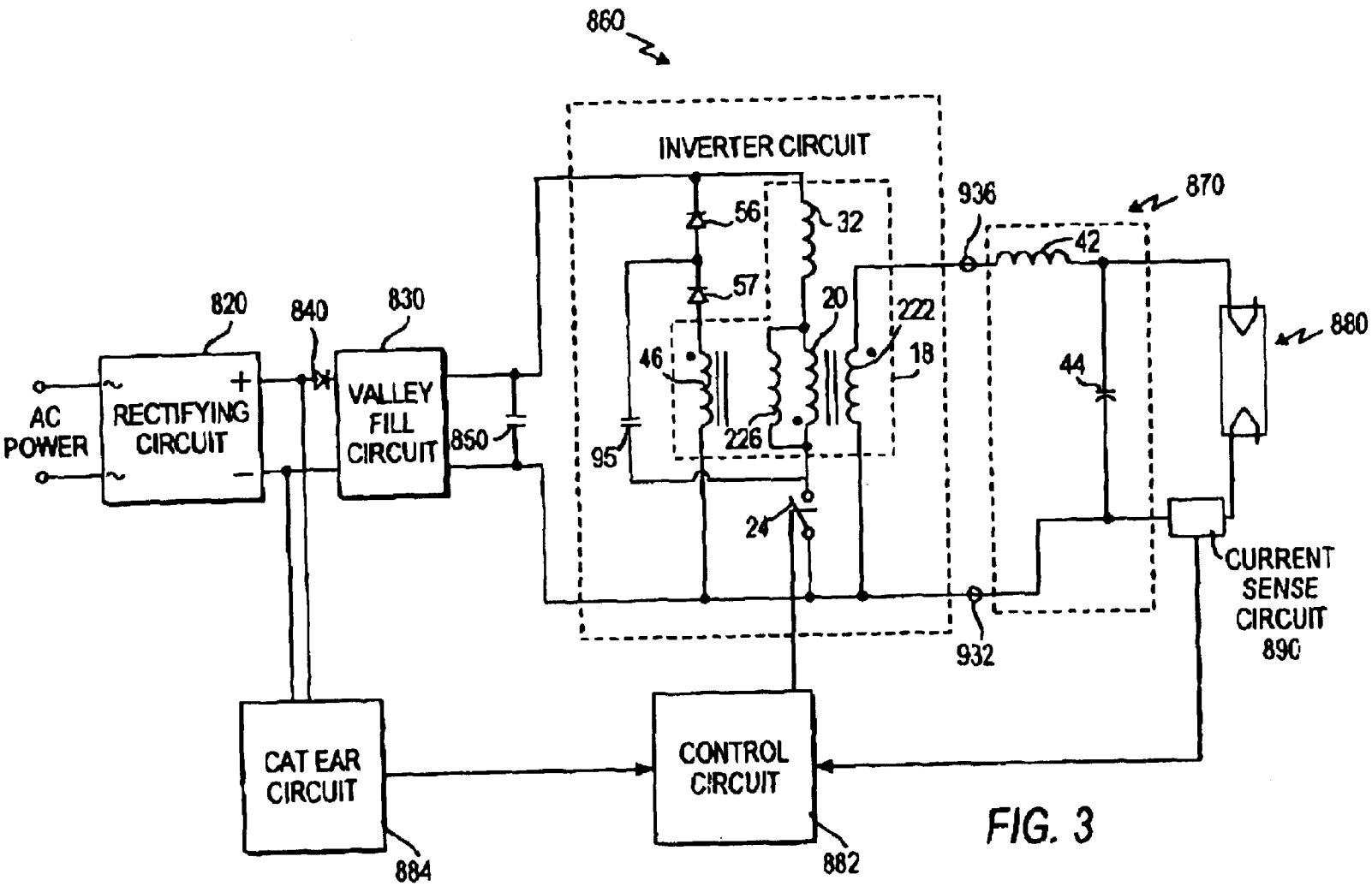
FIG. 3 is a simplified schematic circuit diagram of the single switch inverter with an embodiment of a lossless snubber according to an embodiment of the present invention.

A further improvement in the inverter circuit 860 is shown in FIG. 3 as a lossless snubber. Transformer 18 has an associated leakage inductance 32. During the first state of operation of the inverter circuit, current flowing through second winding 20 also flows through leakage inductance 32. During the second state of operation of the inverter circuit, current established in the leakage inductance 32 will produce an additional voltage stress on controllably conductive device 24 unless an additional circulating path is provided. Capacitor 95 and diode 56 provide the required circulating path. The operation of first winding 46 in FIG. 2 remains the same in FIG. 3 with the addition of another series connected diode 57. The combination of the clamp winding 46 and circulating path of capacitor 95 and diode 56 constrains the voltage stress on controllably conductive device 24. The circulating current path for the leakage inductance current could also be implemented with other well known lossy snubber circuits.

Valley Fill Circuit

Figure 4:
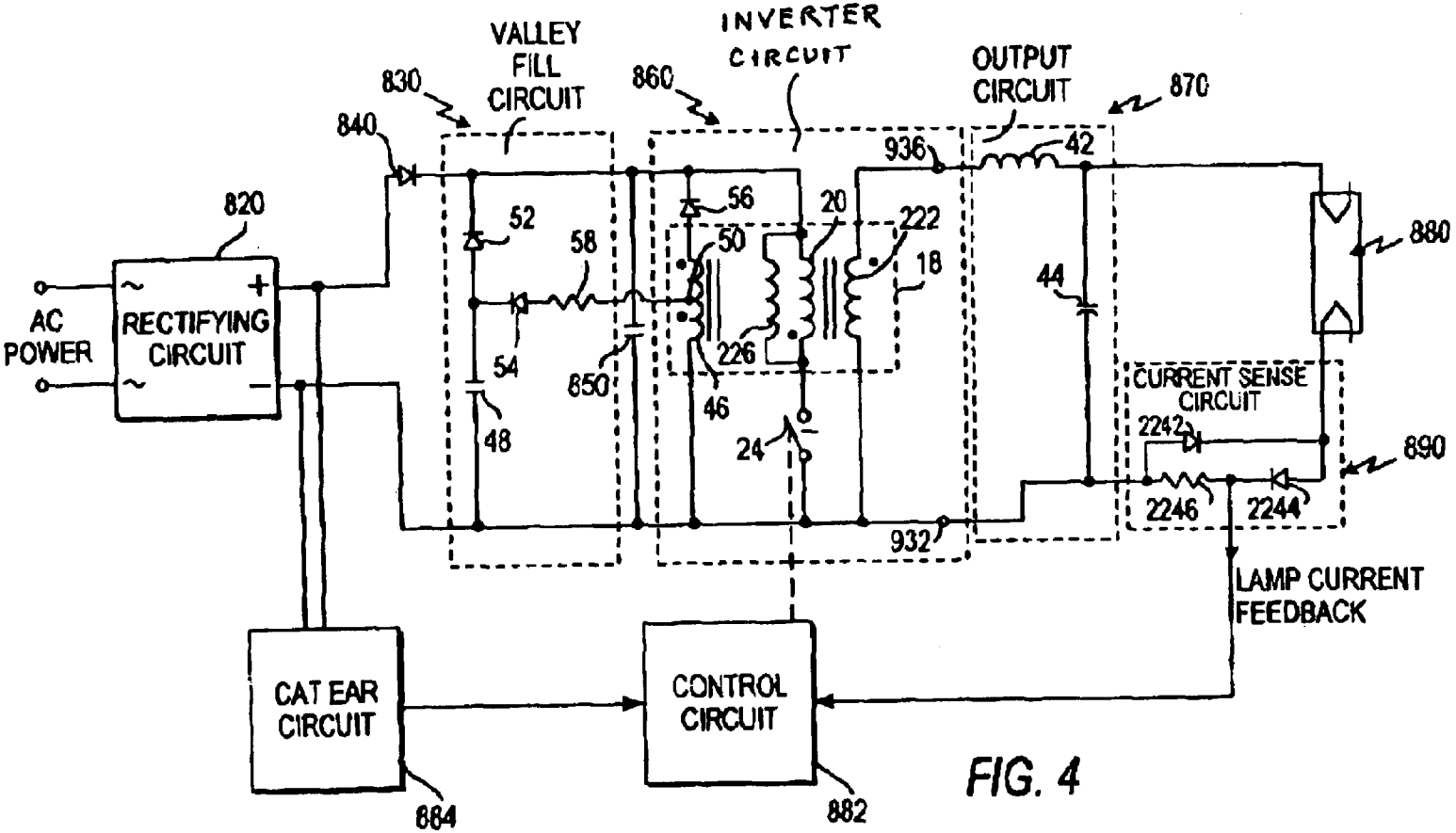
FIG. 4 is a simplified schematic circuit diagram of an embodiment of a valley fill circuit according to an embodiment or the present invention.

A further embodiment of the invention can be seen in FIG. 4, which shows the valley fill circuit 830. The rectifying circuit 820 converts the input AC power connected to the ballast into a full wave rectified voltage. The output of the rectifying circuit 820 is connected to the input of the valley fill circuit 830. The valley fill circuit 830 includes an energy storage device such as a valley fill capacitor 48 and additionally a diode 52. When the full wave rectified voltage from the rectifying circuit 820 is less than the voltage on the valley fill capacitor 48, diode 52 becomes forward biased. With the diode 52 forward biased, the valley fill capacitor 48 is connected to the output of the valley fill circuit and provides current to the inverter circuit. When the output voltage of the rectifying circuit is greater than the voltage on the valley fill capacitor 48, then the output of the valley fill circuit is equal to the output of the rectifying circuit 820. The voltage at the output of the valley fill circuit is referred to as the valley filled voltage (FIG. 5).

Figure 5:
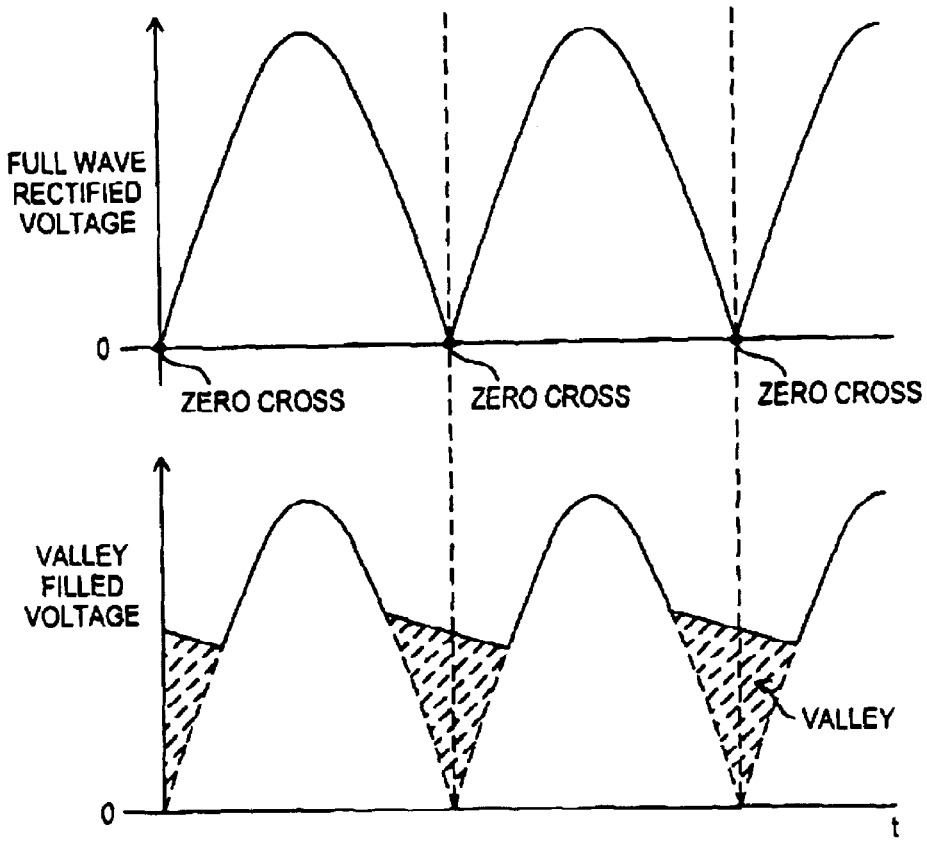
FIG. 5 shows waveforms of full wave rectified voltage and valley filled voltage.

Referring to FIG. 5, the upper waveform shows the output of the rectifying circuit 820 which, for an AC voltage input to the rectifying circuit 820, provides a full wave rectified voltage. The points in time at which the full wave voltage goes to nearly zero are referred to as zero cross. These points correspond to the same points in time that the AC power voltage crosses the zero voltage point as it traverses from the positive half cycle to the negative half cycle and from the negative half cycle to the positive half cycle.

As the full wave voltage approaches zero, it forms a valley between successive peaks. The valley fill circuit is used to fill in the voltage between successive peaks so that the voltage does not reach zero voltage.

However, during about half of the time between the zero crosses, around the peaks of the full wave rectified voltage, the instantaneous valley filled voltage is nearly identical to the full wave rectified voltage. It is only when the instantaneous value of the full wave rectified voltage falls to approximately one half of the peak voltage that the valley fill circuit operates and supplies a nearly DC voltage until the full wave rectified voltage rises to approximately one half of the peak voltage whereupon the valley fill circuit deactivates. The nearly DC voltage has a slight slope in this example because the DC voltage has been supplied by a capacitor and the load current drawn by the inverter circuit causes the capacitor to discharge causing the DC voltage to fall slightly. The resultant valley filled voltage is shown in the lower waveform of FIG. 5.

The clamp winding 46 of the inverter circuit 860 further includes a tap connection 50 (FIG. 4). As previously described, during the second state of the inverter circuit 860 the voltage on the clamp winding 46 was limited to the voltage of the output of the valley fill circuit 860. The tap connection 50 therefore provides a voltage that is a fraction of the total voltage on the clamp winding 46 that is determined by the ratio of the turns of the winding 46 with respect to the location of the tap. If the voltage at the tap 50 is greater than the voltage on the valley fill capacitor 48, a portion of the current that would normally be returned to high frequency bypass capacitor 850 is diverted to the valley fill capacitor 48 through diode 54 and optional resistor 58. This current charges the valley fill capacitor 48. Further since the voltage at the tap 50 must be lower than the voltage on the entire winding 46, the voltage applied to valley fill capacitor 48 is inherently limited to a value less than a fractional value of the peak value of the input rectified voltage. The tap location sets the fractional value of the charging voltage of valley fill capacitor 48. In an embodiment, the tap location is selected to charge the valley fill capacitor 48 to about ½ of the peak value of the rectified ballast input voltage.

A further advantage of charging the valley fill capacitor 48 from clamp winding 46 through tap connection 50 is that the valley fill capacitor 48 charging current is inherently limited. Since this capacitor is the primary energy storage device in the ballast and its charging current is inherently limited, the ballast input current is also inherently limited when AC power is first applied to the ballast. Commercially, it is desirable to limit ballast input current in-rush to less than about 7 amps for ballasts designed to operate from a 120 volt AC power source and about 3 amps for ballasts designed to operate from a 277 volt AC power source.

The Output Circuit

Referring to FIG. 4., a preferred embodiment of the ballast circuit includes an output circuit 870 connected to the output of the inverter circuit 860. The output circuit 870 may comprise an inductor 42 and a capacitor 44. The output circuit 870 receives the inverter circuit 860 output voltage and supplies essentially sinusoidal current to the gas discharge lamp 880. In addition, the output circuit 870 provides voltage gain and increased output impedance. Preferably, the output circuit 870 comprises a resonant tank circuit as shown in FIG. 4. An alternate embodiment of the output circuit 870 would include only an inductor 42. This embodiment would provide increased output impedance but no voltage gain as in the embodiment comprising the resonant tank explained above.

The Current Sense Circuit

Referring to FIG. 4, the ballast also includes a current sense circuit 890, comprising first and second diodes 2242, 2244, and resistor 2246, coupled in series with the lamp 880. The current sense circuit 890 generates a half wave rectified voltage across resistor 2246 that is proportional to lamp current and represents a measure of the actual light output of the gas discharge lamp. This half wave rectified voltage is supplied as an input to the control circuit 882 of FIG. 4. Diode 2242 is a bypass diode for the half cycle not rectified by diode 2244. In an alternative embodiment, the current sensing may be performed in a well-known manner by using a current transformer, or alternatively, diodes connected in a full wave bridge. For non-dimming ballasts, and dimming ballasts where only modest performance is required, the current sense circuit may be omitted.

Figure 4A:
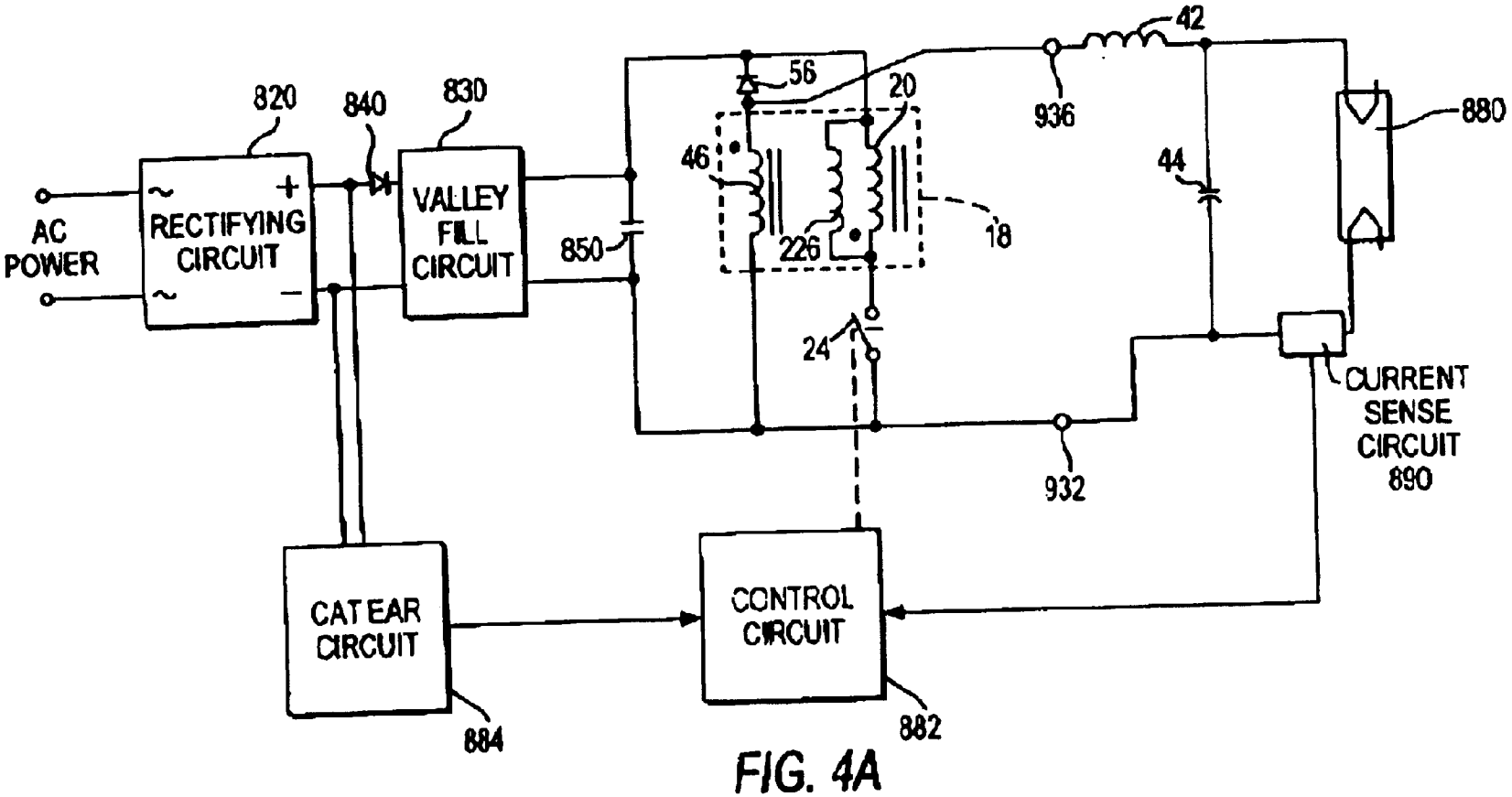
FIG. 4A shows an alternative embodiment of the circuit of the invention.
Figure 4B:
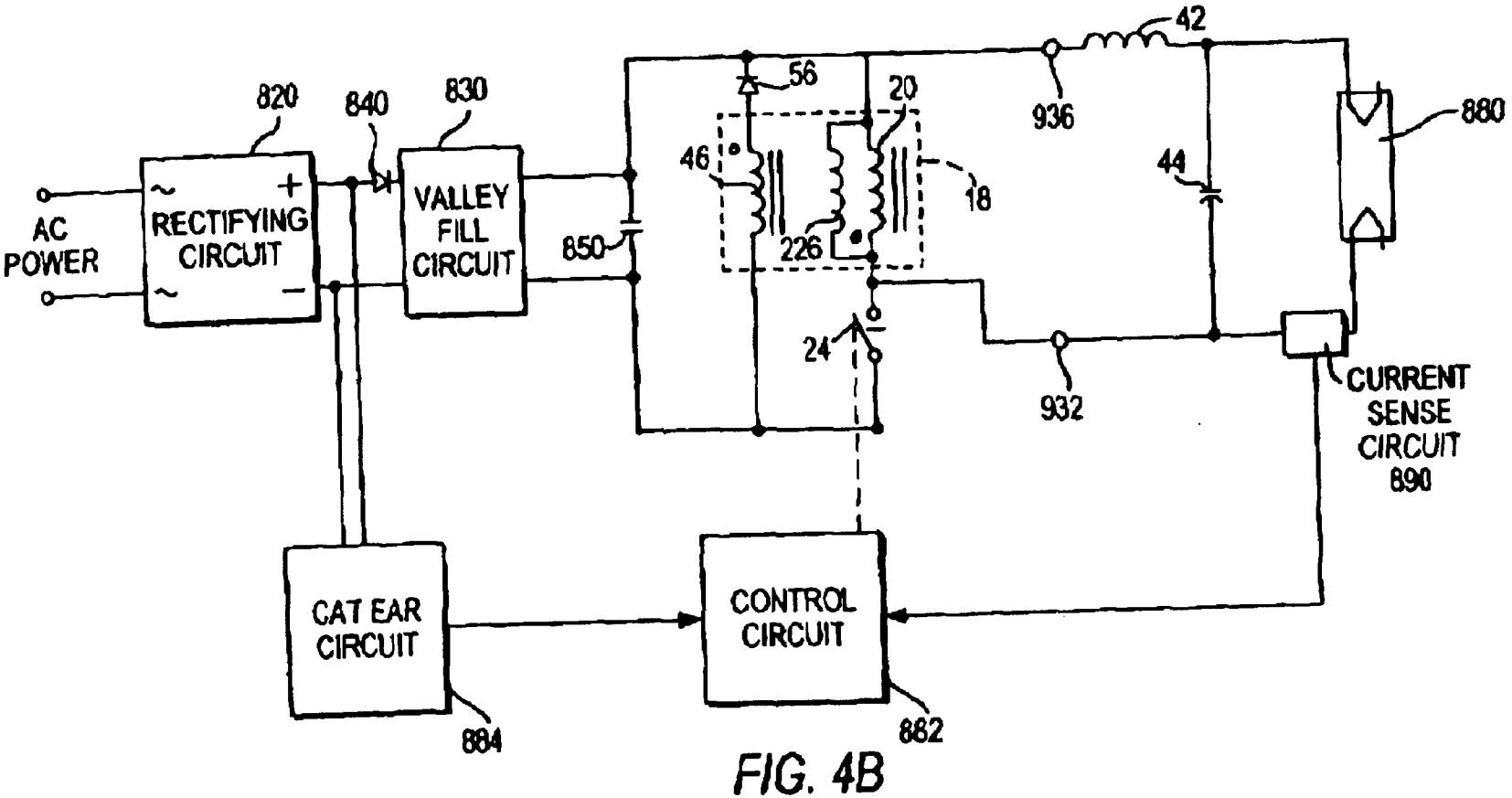
FIG. 4B shows yet a further embodiment of the circuit according to the invention.

FIG. 4A shows an alternative embodiment of the invention in which the output to the lamp is provided from first winding 46. FIG. 4B shows yet another embodiment in which the output is connected to second winding 20. As shown, because the lamp end is no longer referenced to the circuit common, the current sensing circuit of, for example, FIG. 4, must be modified. The current sensing circuit of FIG. 4 can be modified to employ an isolation circuit, for example a current transformer or opto coupler, or any other suitable isolation circuit.

The Control Circuit

Figure 6:
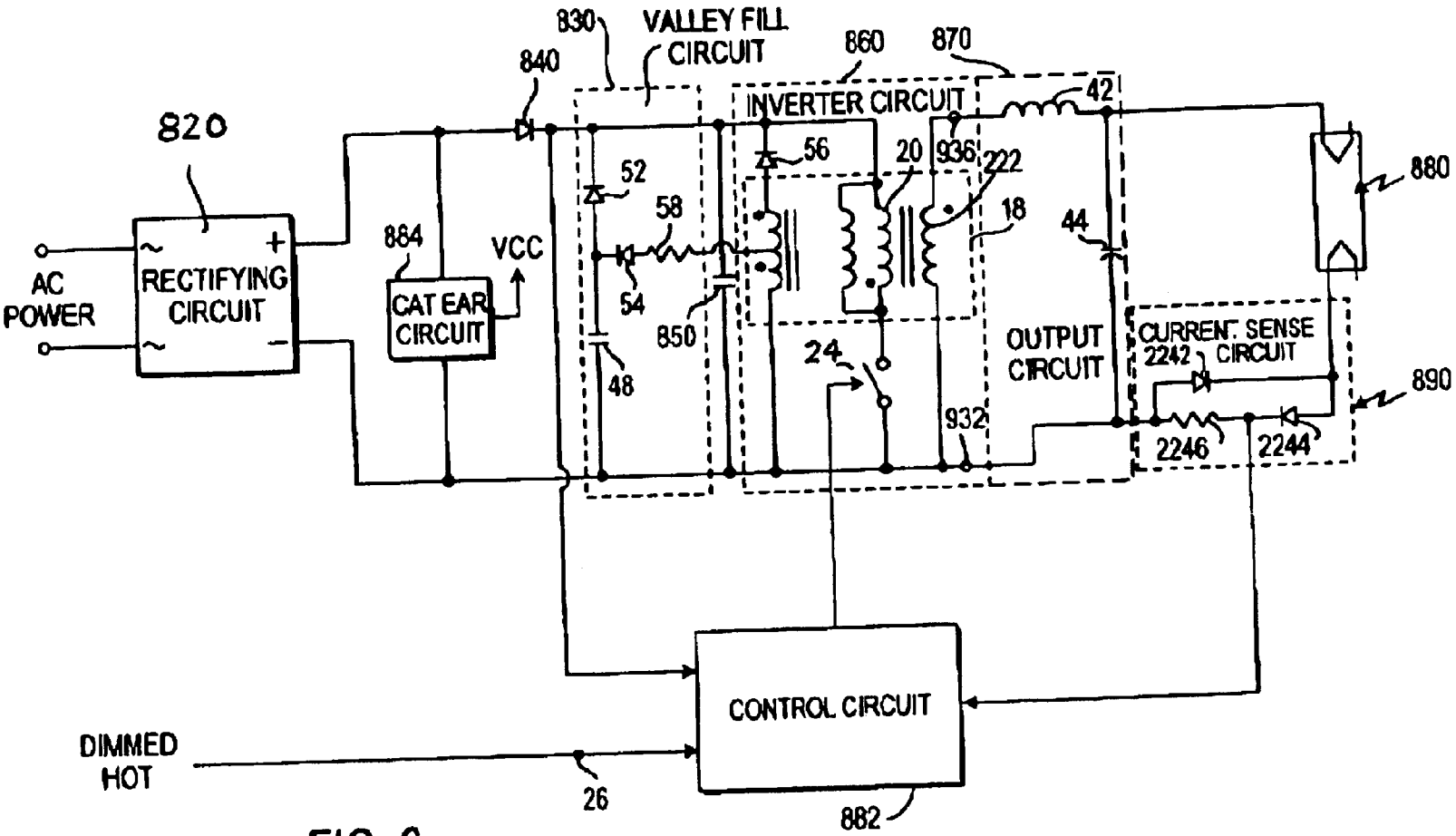
FIG. 6 is a simplified schematic diagram of an embodiment of a current sense circuit according to an embodiment of the present invention.

The control circuit 882 of FIG. 1 will be described in more detail with reference to FIG. 6. A first embodiment of the control circuit 882 generates signals to control the conduction of the controllably conductive device 24 (FIG. 6). The functionality of the control circuit 882 is to provide the necessary control signal to the controllably conductive device 24 so that the ballast of the invention delivers the appropriate output to a connected gas discharge lamp 880.

The control circuit 882 receives as an input a signal 26 indicative of the requested light level. This input signal is used to produce a reference signal for closed loop control of the lamp current.

Figure 7:
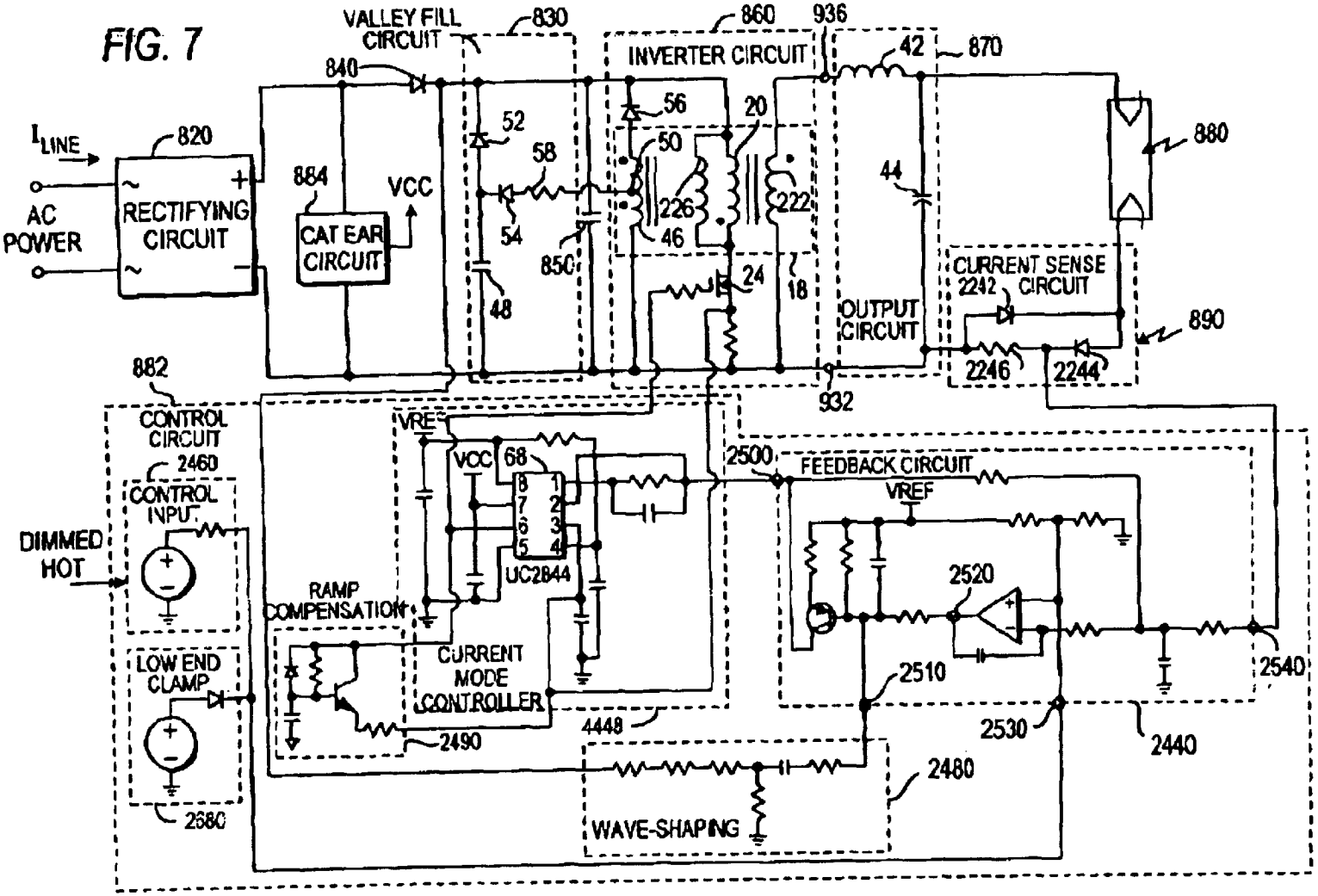
FIG. 7 is a simplified schematic diagram of an embodiment of the present invention.

Additionally, the control circuit 882 receives as an input, the half wave rectified voltage from the current sense circuit 890 and generates a DC voltage that represents actual light output of the connected lamp(s). This DC voltage, representative of light output, is compared to a reference voltage, indicative of a requested light level, to generate an error signal that is used to adjust the conduction time of the controllably conductive device 24 so as to minimize the difference between the voltage representative of the light output and the reference voltage. In an electronic dimming ballast, the reference voltage may be provided by an external input such as a 0-to-10 Volt control signal. Alternatively, the reference voltage may be generated by detecting a phase angle control signal applied to the ballast by means of the AC line voltage when the ballast is supplied through a 2 wire dimming control. In the prefered embodiment of the ballast, the reference voltage is generated from a phase angle control signal applied to the ballast via an additional input to the ballast, such as is depicted in FIGS. 6, 7 by the "Dimmed Hot" input.

In one embodiment, the control circuit 882 includes a feedback circuit 2440 (FIG. 7) connected to receive inputs from the current sense circuit 890 and a control input circuit 2460, and supplies a conduction signal to the control terminal of the controllably conductive device 24. The control circuit 882 may optionally include a wave shaping circuit 2480 to provide an additional input to the feedback circuit 2440, as will be described in detail below.

The operation of control circuit 882 is as follows. Feedback circuit 2440 comprises components (operational amplifier-resistor-capacitor-transistor-etc) connected to form a standard proportional-integral controller. This feedback circuit 2440 includes three inputs and one output; a non-inverting input 2530, an inverting input 2540, a wave shaping input 2510, and output 2500. The non-inverting input 2530 receives as a signal a voltage from the control input circuit 2460. This voltage is representative of the requested light level. The inverting input 2540 receives a signal, from current sense circuit 890, which is representative of the actual light output being delivered by the connected lamp. Wave shaping input 2510 receives a signal from wave shaping circuit 2480 which is used to modify the output of the proportional-integral controller 2500. The signals at the inverting and non-inverting inputs 2530,2540 are compared to form an error signal at the output 2520 of the op-amp contained in feedback circuit 2440. This output 2520 is combined with wave shaping input 2510 to form a composite signal at output terminal 2500 of feedback circuit 2440. This output of the feedback circuit 2500 provides a current to drive the input of a standard current mode control circuit 4448 comprising a current mode control IC 68 such as a UC2844. Current mode control IC 68 is well known for providing peak current mode control of a controllably conductive device. The ballast of this invention uses this controller in its well known configuration for operation of a flyback type power supply. Additionally, known techniques for ramp compensation of the UC2844 controller, IC 68, can be applied to the present design for additional improvements in the stability of the feedback loop. The ramp compensation circuit 2490 shown in FIG. 7 is one possible way of providing ramp compensation. The ramp compensation circuit adds a ramp voltage to the current sense input of the UC2844 controller, IC 68. The peak of the ramp voltage is proportional to the conduction time of the controllably conductive device 24.

The wave shaping circuit 2480 provides an AC reference voltage signal to the feedback circuit. This reference signal modulates the desired lamp current over a line frequency half cycle. While the shape of the AC reference voltage signal can be made to take on a variety of wave shapes, a particularly effective, yet simple, circuit can be designed that takes advantage of the waveforms already present in the ballast. The wave shaping circuit 2480 (FIG. 7) provides a signal to the feedback circuit 2440 that is proportional to the AC ripple of the valley filled voltage.

The control circuit also includes a low end clamp 2680 connected between the output of the control input circuit and circuit common. The low end clamp 2680 prevents the reference voltage from going so low that the current through the lamp cannot be sustained.

Conventional control algorithms used for controlling electronic ballast inverters typically adjust the conduction time of the controllably conductive devices so as to maintain RMS lamp current at a constant value. Conventional control loops are relatively slow in response so as to keep the conduction times of the controllably conductive devices nearly constant during a line frequency half cycle. This algorithm when applied to a valley fill type ballast would result in a high current crest factor of the lamp current due to the modulation of the valley filled voltage.

In the prefered embodiment, the feedback loop is designed to be relatively fast such that it is able to respond to the ripple on the valley filled voltage. In the absence of the wave shaping circuit 2480, the feedback loop will attempt to keep the magnitude of the high frequency lamp current constant during a line frequency half cycle. It does this by reducing the conduction time of the controllably conductive device during the time around the time of the peak of the absolute value of the line voltage. This would result in low lamp current crest factor, but would also result in a high ballast input current total harmonic distortion. The wave shaping circuit 2480 provides an AC reference signal to the feedback circuit. The valley filled voltage is divided down to provide a signal level voltage using a resistive divider. This signal level voltage is then AC coupled to the feedback circuit using a capacitor to provide the AC reference signal. This reference signal prevents the feedback loop from reducing the conduction time of the single controllably conductive device 24 as much as it would otherwise have done during the time around the time of the peak of the absolute value of the line voltage. The combination of the feedback loop provided by feedback circuit 2440 and the wave shaping circuit 2480 results in a lamp current crest factor that is lower than what would be achieved with a conventional relatively slow loop and a ballast input current total harmonic distortion that is lower than what would be achieved with a relatively fast loop by itself. The magnitude of the wave shaping signal 2510 can be chosen to achieve a balance between lamp current crest factor and ballast input current total harmonic distortion.

Electronic dimming ballasts constructed with the wave shaping circuit 2480 as described have achieved stable operation with ballast input current total harmonic distortion below 20% and lamp current crest factor below 1.7.

Although an embodiment of control circuit 882 is shown in the drawings, it may also be construced based on a microprocessor, as would be apparent to those of skill in the art. One such microprocessor suitable for this use is manufactured by Motorola Corp. of Austin, Tex. under the model number MC68HCO8. Suitable analog-to-digital and digital-to-analog circuits necessary for interfacing the microprocessor are known to those of skill in the art.

Other embodiments of the control circuit can also be provided. For example, the control circuit could be based on a digital signal processor (DSP) or application specific integrated circuit (ASIC) providing the same functionality.

The Cat Ear Circuit

Figure 8:
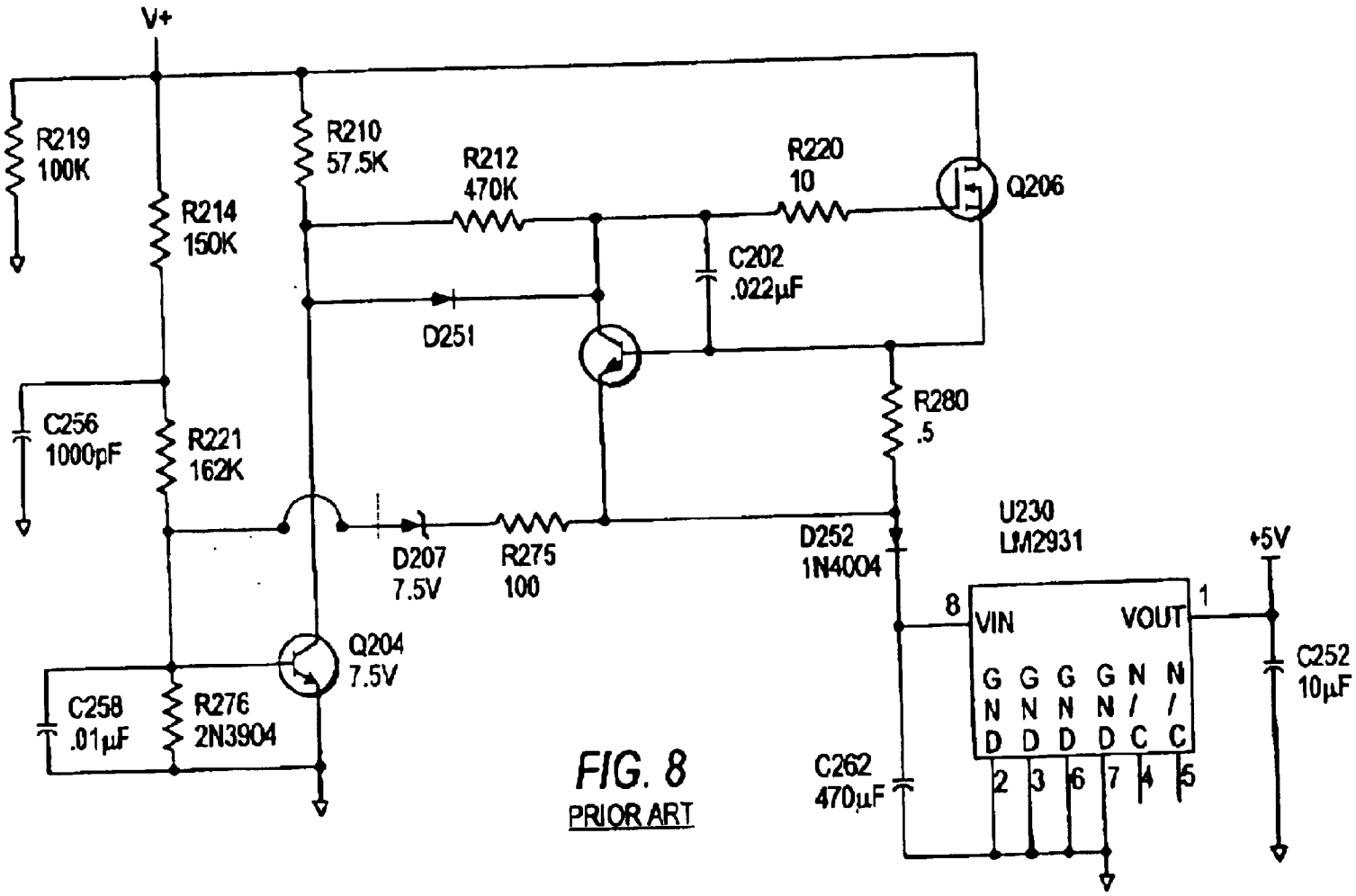
FIG. 8 PRIOR ART
FIG. 8 is a simplified schematic diagram of a prior art cat ear power supply.

Cat ear circuits have been used for years to provide power for control circuits in two-wire, triac based dimmers for incandescent lamps and controllers for fan motors. A typical prior art cat ear circuit is shown in FIG. 8. Standard electronic dimmers for lighting loads are well known. In standard electronic dimmers, the dimmer is located between the AC line and the load, receiving as input sinusoidal voltage from the AC line and providing as an output a "truncated" form of the sinusoidal input voltage in which the leading edge of the input voltage waveform is blocked by the non-conducting triac, and only the trailing portion of the input voltage waveform is passed on to the load by the triac, when the triac is conducting. The triac is turned on at a predetermined time and conducts until the next zero crossing of the input voltage waveform. By varying the time until conduction of the triac, with respect to the zero crossing of the AC line voltage, the amount of power delivered to the load may be controlled.

The prior art cat ear circuit of a two wire dimmer draws power from the AC line, during a portion of the input voltage waveform when the triac is not conducting. In other words, the prior art cat ear circuit draws current from the line, through the load, during the time when no significant load current would normally flow. However, until now, cat ear circuits have only been used to derive an auxilary power supply to operate control circuits within an electronic device. They have not been used for the purpose of deliberately shaping the input current drawn from the line by an electronic device. Specifically, cat ear circuits, until now, have not been used in electronic ballasts to assist in the shaping of input current nor have they been used as an auxiliary power supply in an electronic ballast. In the ballast of the invention the input current shaping benefits of the cat ear circuit contribute to the reduction of ballast input current total harmonic distortion.

An alternative embodiment of the ballast includes a cat ear circuit 884 (FIG. 6) connected across the outputs of the rectifying circuit 820. The cat ear circuit 884 may be generally defined as a circuit that is designed to draw current from the line during selected portions of the AC line cycle. The cat ear circuit 884 may thus be used in a novel and unique manner for shaping the ballast input current waveform so as to improve ballast input current total harmonic distortion. Indeed, the cat ear circuit may be used for shaping the input current waveform of a variety of electronic devices, such as switch-mode power supplies and AC line-to-DC converters, thereby, reducing input current total harmonic distorition.

Figure 9:
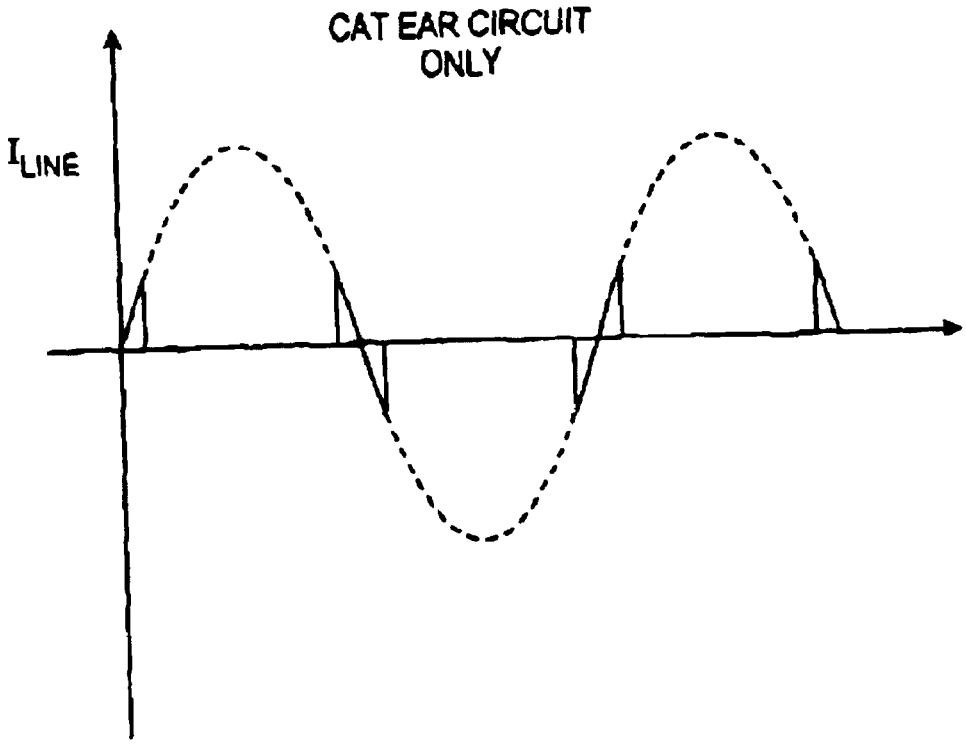
FIG. 9 shows a simplified waveform of the line current drawn by the cat ear circuit according to an embodiment of the present invention.
Figure 10:
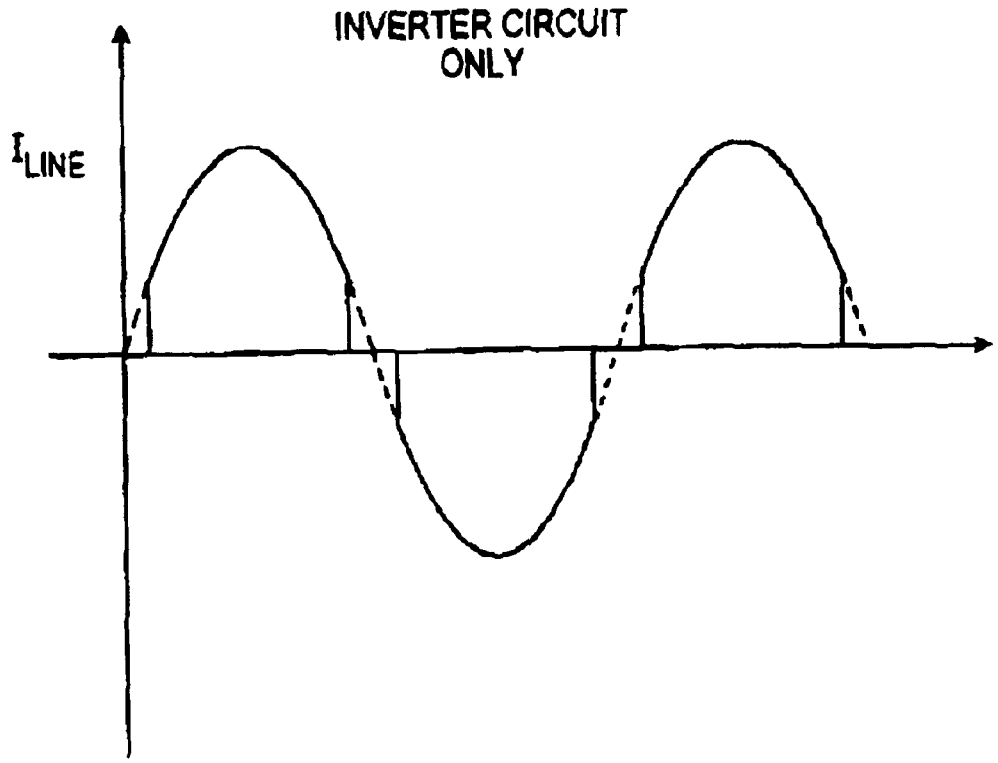
FIG. 10 shows a simplified waveform of the line current drawn by the inverter circuit according to an embodiment of the present invention.

The cat ear circuit 884 (FIG. 6) draws current from the rectifying circuit 820 only during the regions of the input AC line cycle near the line voltage zero crossings, as shown in FIG. 9. The cat ear circuit 884, draws current near line voltage zero crossing and thereby "fills in" the input line current drawn from the AC, line when the inverter circuit 860 of the ballast is not drawing current from the AC line (FIG. 10). By filling in near the zero crossings, the line current drawn by the ballast is made more continuous, thereby reducing ballast input current total harmonic distortion, as will be described in connection with FIG. 11.

Figure 12:
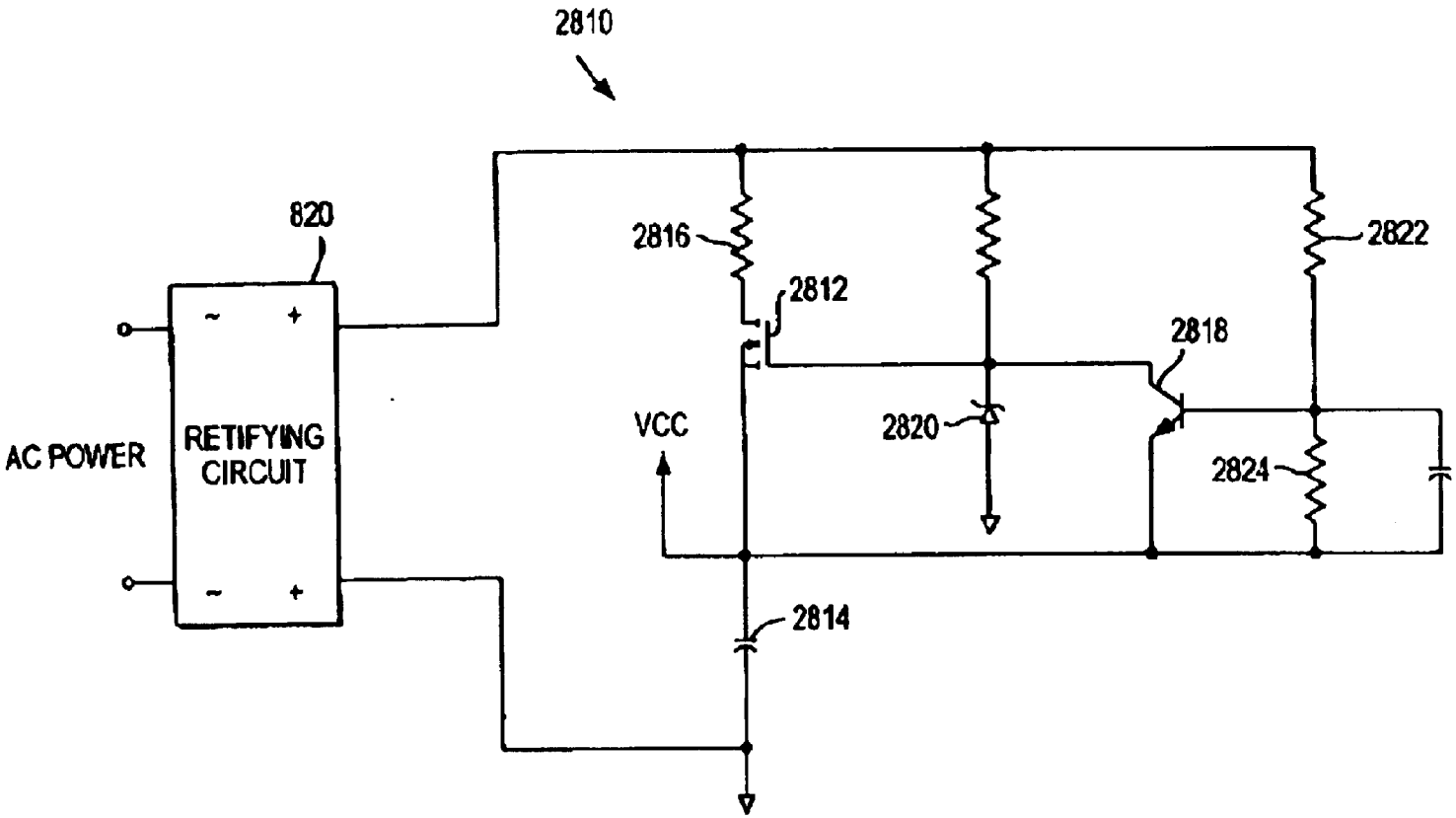
FIG. 12 is a simplified schematic diagram of an embodiment of the cat ear circuit according to an embodiment of the present invention.

A first embodiment of the cat ear circuit 884, is identified as 2810 in FIG. 12. The cat ear circuit 2810 is designed with fixed voltage cut-in and cut-out points. That is, the first embodiment 2810 of the cat ear circuit will only draw current from the AC line when the rectified line voltage is below a fixed value. This condition will occur for a period of time near the line voltage zero crossing. The cut-out and cut-in voltage points can be adjusted so that the cat ear circuit 2810 draws current during a first interval from a time just after the line voltage zero crossing to a time when the inverter circuit 860 FIG. 1 is drawing current from the AC line, and during a second interval from a time when the inverter circuit 860 FIG. 1 stops drawing current from the AC line until the next line voltage zero crossing (FIG. 9).

Figure 11:
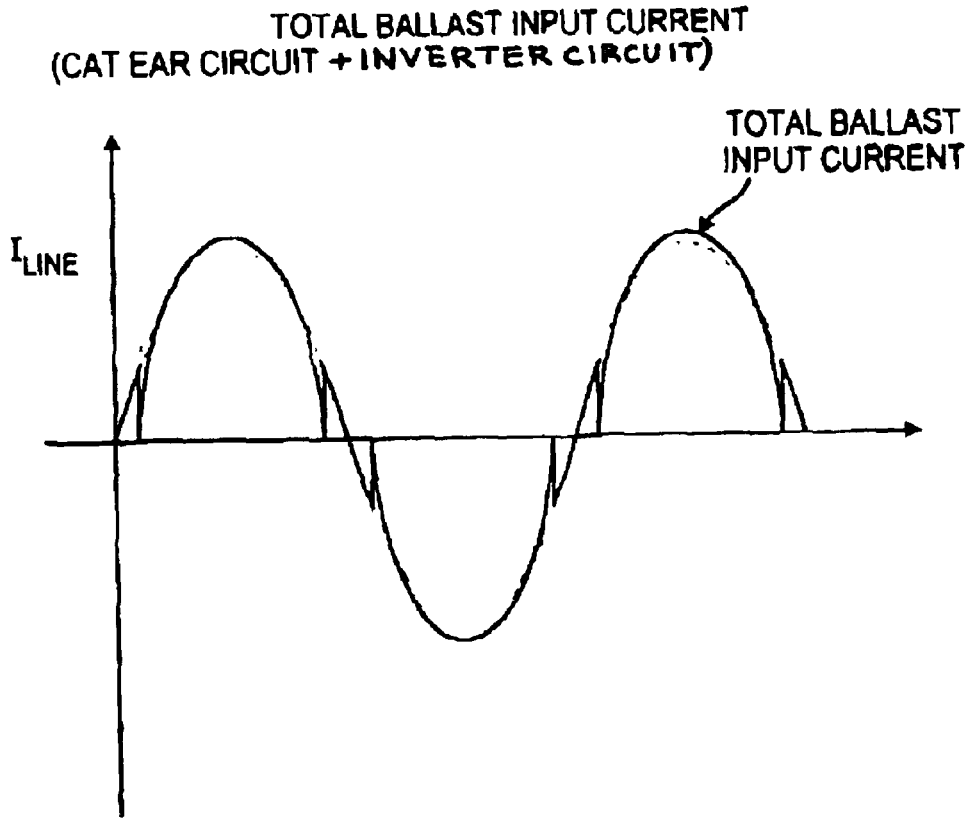
FIG. 11 shows a simplified waveform of total ballast input current (line current) according to an embodiment of the present invention.

When the rectified line voltage is lower than a selected voltage, a charging transistor 2812 (FIG. 12) conducts to allow charging of an energy storage capacitor 2814, which charges toward a voltage VCC. The rate of charge of the capacitor 2814 is determined by a resistor 2816 in series with the drain of the MOSFET transistor 2812. This current drawn by the cat ear circuit when combined with the current drawn by the back end circuit of the ballast combines to form a substantially piece-wise continuous ballast input current (FIG. 11). The back end typically includes the inverter circuit 860 and the output circuit 870. Although the transistor 2812 is shown as a MOSFET, it may be any suitable controllably conductive device, such as, without limitation, a BJT or an IGBT.

When the rectified line voltage is equal to or greater than the predetermined voltage, then cut-out transistor 2818 begins conducting. The collector of the cut-out transistor 2818 pulls the cathode of a zener diode 2820 toward VCC, which effectively turns off the charging transistor 2812. The predetermined cut-in and cut-out voltages are determined by the resistive voltage divider network including resistors 2822 and 2824, to which the base of the cut-out transistor 2818 is connected. The zener 2820 determines the voltage VCC.

The cat ear circuit enables the ballast to draw current during a predetermined portion of each half cycle of the AC line. This portion can include periods before and after line voltage zero crossings, or only one such period, or any other useful period during the line cycle. It should also be noted that the cat ear circuit of the invention also provides a power supply for the control circuit of the ballast. This is shown by supply voltage VCC.

Figure 13:
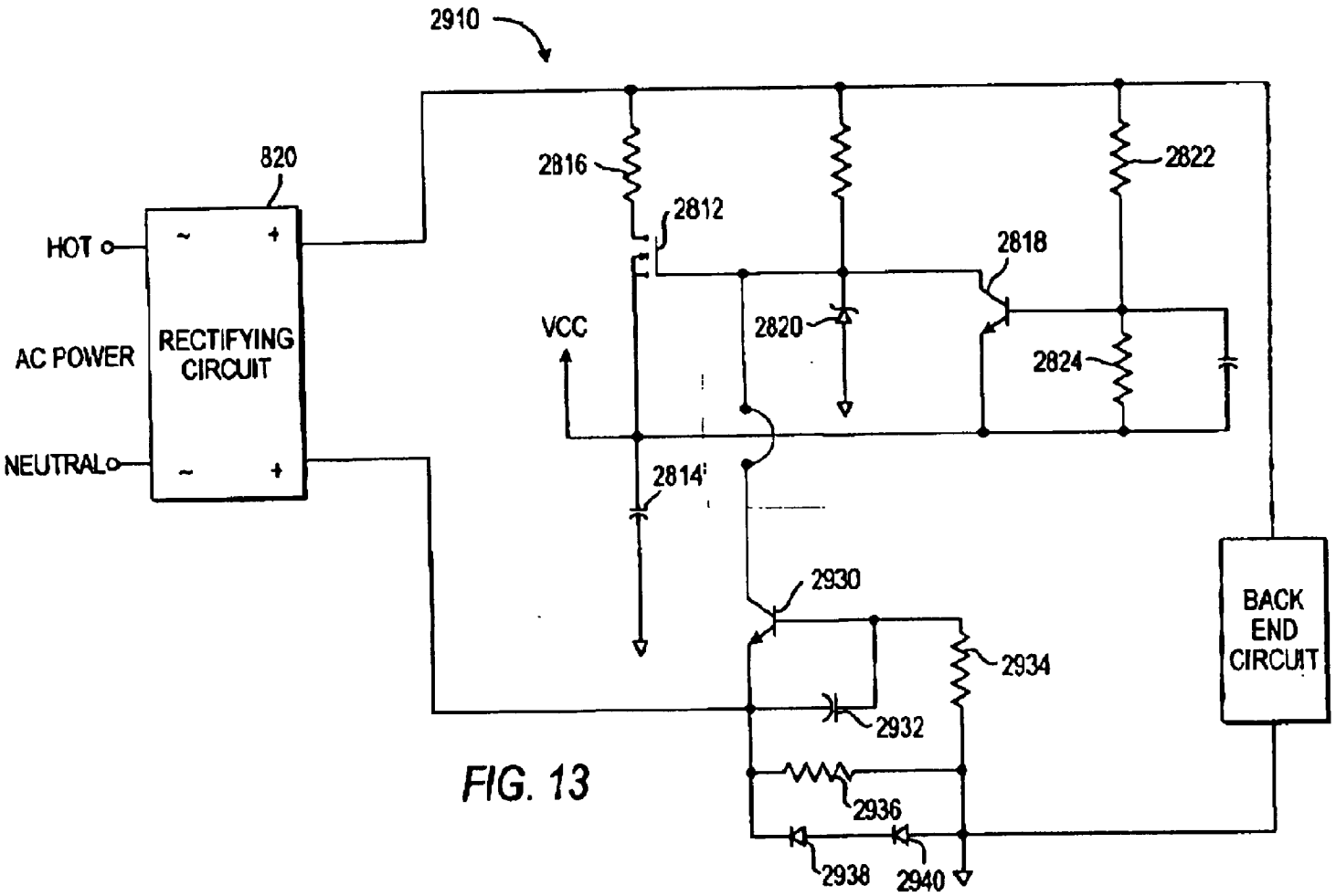
FIG. 13 is a simplified schematic diagram of a second embodiment of a cat ear circuit that actively monitors current drawn from the back end of the ballast according to an embodiment of the present invention.

A second embodiment 2910 of the cat ear circuit 884, is shown in FIG. 13. The cat ear circuit 2910 includes a circuit that actively monitors current drawn from the back end circuit of the ballast and causes the cat ear circuit to draw current from the line only when the back end is not drawing current above a predetermined value. The current monitor circuit includes transistor 2930, capacitor 2932, resistors 2934, 2936, and diodes 2938, 2940. The ballast back end current flows through diodes 2938, 2940 and resistor 2936 as it returns to the rectifying circuit 820. When the ballast back end is drawing current above the predetermined value, the voltage at the emitter of transistor 2930 goes negative by a voltage equivalent to the combined forward voltage drops of diodes 2938, 2940. Through resistor 2934, the transistor 2930 base-emitter junction becomes forward biased, thereby turning transistor 2930 on. Turning transistor 2930 on pulls the gate of transistor 2812 low, thereby turning off transistor 2812. When back end current falls below the predetermined value, set by the value of resistor 2936, the transistor 2930 turns off allowing transistor 2812 to turn on and providing a charging path for capacitor 2814. This second embodiment yields a slight improvement in ballast input current total harmonic distortion over the first embodiment.

The particular embodiments of the cat ear circuit that have been described show the cat ear circuit connected to the source of AC power through the rectifying circuit. Of course, it would be possible to build a cat ear circuit that connects directly to the source of AC power rather that through the rectifying circuit. For example, the particular embodiments of the cat ear circuit that have been described could alternately include a separate rectifier for connection to the source of AC power.

In addition to providing a means for shaping the input current drawn by the ballast so as to improve ballast input current total harmonic distortion, the cat ear circuit provides the following additonal feature. The cat ear circuit advantageously provides a faster start-up of the ballast and is not affected by the operating mode of the ballast in the same way that typical prior art trickle-charge and bootstrap systems are affected. Effectively, the cat ear circuit 884 and the inverter circuit 860 are decoupled from each other allowing the fine tuning of each without affecting the other.

The result of combining the valley fill circuit, control circuits, and cat ear circuit of the present invention may be seen in FIG. 11 which shows an idealized ballast input current waveform. The cat ear circuit comprises means for drawing input current near the zero crossing of the input AC line voltage waveform so that the ballast input current total harmonic distortion is substantially reduced. In other words, the cat ear circuit fills in the current waveform near the zero crossings.

The valley fill circuit of the invention comprise means for charging an energy storage device over a substantial portion of each half cycle of the AC input voltage so that the ballast input current total harmonic distortion is reduced. This is depicted in the idealized waveform of FIG. 11 wherein it may be seen that in the middle portion of each line half cycle, the ideal current waveform conforms substantially to a sinusoidal current waveform.

Although the present invention has been described in relation to particular embodiments thereof many other variations and modifications and other uses will become apparent to those skilled in the art. It is preferred, therefore, that the present invention be limited not by the specific disclosure herein, but only by the appended claims.

What is claimed is:

1. An electronic ballast for driving at least one gas discharge lamp from a source of AC power which has a substantially sinusoidal line voltage at a given line frequency, comprising:

a rectifying circuit having AC input terminals and DC output terminals, said AC input terminals connectable to said source of AC power, said rectifying circuit producing a rectified output voltage at its said DC output terminals when said AC input terminals are energized by said source of AC power;

a valley fill circuit having input and output terminals; said input terminals of said valley fill circuit connected to said DC output terminals of said rectifying circuit;

an inverter circuit having input terminals and output terminals; said input terminals of said inverter circuit connected to said output terminals of said valley fill circuit and said output terminals of said inverter circuit connectable to said at least one gas discharge lamp and producing a high frequency drive voltage for driving a lamp current through said at least one gas discharge lamp when said AC input terminals are energized by said source of AC power;

said inverter circuit comprising a single controllably conductive device and an inductor; said inductor connectable to said at least one gas discharge lamp;

said inverter circuit being adapted to draw current from said source of AC power whereby the total current drawn from said source of AC power has a total harmonic distortion below about 33.3%; and whereby the lamp current has a current crest factor below about 2.1.

2. The electronic ballast of claim 1, which further includes a cat ear circuit connected to said source of AC power; said cat ear circuit being adapted to conduct current from said source of AC power for a first relatively short time following a first zero crossing of said substantially sinusoidal line voltage and for a second relatively short time prior to the next zero crossing of said line voltage thereby to reduce the ballast input current total harmonic distortion from that which would occur in the absence of said cat ear circuit.

3. The electronic ballast of claim 2 wherein the total current drawn from said source of AC power has total harmonic distortion below about 20%.

4. The electronic ballast of claim 2 wherein said cat ear circuit draws current from said source of AC power only when an instantaneous value of said line voltage is less than a predetermined absolute value.

5. The electronic ballast of claim 2 wherein said cat ear circuit draws current from said source of AC power at least during a time when an instantaneous value of said line voltage is less than a predetermined absolute value.

6. The electronic ballast of claim 2 wherein said cat ear circuit draws current from said source of AC power at least when said current drawn by said inverter circuit is substantially zero.

7. An electronic ballast for driving at least one gas discharge lamp from a source of AC power which has a substantially sinusoidal line voltage at a given line frequency, comprising:

a rectifying circuit having AC input terminals and DC output terminals, said AC input terminals connectable to said source of AC power, said rectifying circuit producing a rectified output voltage at its said DC output terminals when said AC input terminals are energized by said source of AC power;

a valley fill circuit having input and output terminals; said input terminals of said valley fill circuit connected to said DC output terminals of said rectifying circuit;

an inverter circuit having input terminals and output terminals; said input terminals of said inverter circuit connected to said output terminals of said valley fill circuit and said output terminals of said inverter circuit connectable to said at least one gas discharge lamp and producing a high frequency drive voltage for driving a lamp current through said at least one gas discharge lamp when said AC input terminals are energized by said source of AC power;

said inverter circuit comprising a single controllably conductive device and an inductor;

said inductor connectable to said at least one gas discharge lamp;

said inverter circuit being adapted to draw current from said source of AC power whereby the total current drawn from said source of AC power has a total harmonic distortion below about 33.3%; and whereby the lamp current has a current crest factor below about 1.7.

8. An electronic ballast for driving at least one gas discharge lamp from a source of AC power which has a substantially sinusoidal line voltage at a given line frequency, comprising:

a first rectifying circuit having AC input terminals and DC output terminals, said AC Input terminals connectable to said source of AC power, said first rectifying circuit including a first rectifier producing a rectified output voltage at its said DC output terminals when said AC input terminals are energized by said source of AC power;

a valley fill circuit having input and output terminals; said input terminals of said valley fill circuit connected to said DC output terminals of said first rectifying circuit, said valley fill circuit including an energy storage device connected to said output terminals of said valley fill circuit;

an inverter circuit having input terminals and output terminals; said input terminals of said inverter circuit connected to said output terminals of said valley fill circuit and said output terminals of said inverter circuit connectable to said at least one gas discharge lamp, and producing a high frequency drive voltage for driving a lamp current through said at least one gas discharge lamp when said AC input terminals are energized by said source of AC power;

said inverter circuit including a single controllably conductive device and further including a winding and a second rectifier connected to one another and to said output terminals of said valley fill circuit whereby the maximum voltage across said winding is limited to the instantaneous voltage at said output terminals of said valley fill circuit when said controllably conductive device is non conductive.

9. The electronic ballast of claim 8 wherein said winding contains a plurality of turns and further including a tap connection to one of said turns of said winding; said tap connection connected to said energy storage device and operable to charge said energy storage device to a desired voltage.

10. The electronic ballast of claim 9 wherein said electronic ballast draws a ballast input current from said source of AC power and said tap is located on a turn of said winding which is selected to minimize the total harmonic distortion of said ballast input current.

11. The electronic ballast of claim 9 wherein said tap is located at an approximately middle turn of said plurality of turns of said winding.

12. The electronic ballast of claim 9 wherein said tap is located at a turn on said winding which is selected to minimize the current crest factor of said lamp current.

13. An electronic ballast for driving at least one gas discharge lamp from a source of AC power which has a substantially sinusoidal line voltage at a given line frequency, comprising:

a first rectifying circuit having AC input terminals and DC output terminals, said AC input terminals connectable to said source of AC power, said first rectifying circuit including a first rectifier producing a rectified output voltage at its said DC output terminals when said AC input terminals are energized by said source of AC power;

an inverter circuit having input terminals and output terminals; said input terminals of said inverter circuit connected to said output terminals of said first rectifying circuit and said output terminals of said inverter circuit connectable to said at least one gas discharge lamp, and producing a high frequency drive voltage for driving a lamp current through said at least one gas discharge lamp when said AC input terminals are energized by said source of AC power;

said inverter circuit comprising a single controllably conductive device, a second rectifier and a transformer; said transformer including a first and second winding; said first winding connected to said DC output terminals of said first rectifying circuit through said second rectifier, whereby the voltage on said first winding is limited to the voltage at said input terminals of said inverter circuit during a non-conductive state of said single controllably conductive device, and further wherein the voltage on said first winding determines a maximum voltage stress on said single controllably conductive device during a non-conduction state of said single controllably conductive device, and establishes a maximum instantaneous voltage on said second winding of the transformer during a non-conduction state of said single controllably conductive device; said second winding being connected to said single controllably conductive device.

14. The electronic ballast of claim 13, which further includes a third winding coupled to said first and second windings; said third winding producing a high frequency drive voltage for driving a lamp current through said at least one gas discharge lamp when said AC input terminals are energized by said source of AC power.

15. The electronic ballast of claim 13 wherein said first winding produces a high frequency drive voltage for driving a lamp current through said at least one gas discharge lamp when said AC input terminals are energized by said source of AC power.

16. The electronic ballast of claim 13 wherein the second winding produces a high-frequency voltage for driving a lamp current through said at least one gas discharge lamp when said AC input terminals are energized by said source of AC power.

17. An electronic ballast for driving at least one gas discharge lamp from a source of AC power which has a substantially sinusoidal line voltage at a given line frequency, comprising:

a rectifying circuit having AC input terminals and DC output terminals, said AC input terminals connectable to said source of AC power, said rectifying circuit producing a rectified output voltage at its said DC output terminals when said AC input terminals are energized by said source of AC power;

a valley fill circuit having input and output terminals; said input terminals of said valley fill circuit connected to said DC output terminals of said rectifying circuit, said valley fill circuit including an energy storage device connected to said output terminals of said valley fill circuit;

an inverter circuit having input terminals and output terminals; said input terminals of said inverter circuit connected to said output terminals of said valley fill circuit and said output terminals of said inverter circuit connectable to said at least one gas discharge lamp, and producing a high frequency drive voltage for driving a lamp current through said at least one gas discharge lamp when said AC input terminals are energized by said source of AC power;

said inverter circuit comprising a clamp winding coupled to said energy storage device of said valley fill circuit whereby said clamp winding diverts current to said energy storage device to recharge said energy storage device, wherein said current diverted by said clamp winding is the only current which recharges said energy storage device of said valley fill circuit.

18. An electronic ballast for driving at least one gas discharge lamp from a source of AC power which has a substantially sinusoidal line voltage at a given line frequency, comprising:

a rectifying circuit having AC input terminals and DC output terminals, said AC input terminals connectable to said source of AC power, said rectifying circuit producing a rectified output voltage at its said DC output terminals when said AC input terminals are energized by said source of AC power;

an inverter circuit having input terminals and output terminals; said input terminals of said inverter circuit connected to said output terminals of said rectifying circuit;

an output circuit having input terminals and output terminals; said input terminals of said output circuit connected to said output terminals of said inverter circuit; and said output terminals of said output circuit connectable to said at least one gas discharge lamp;

said inverter circuit producing a high frequency drive voltage for driving a lamp current through said at least one gas discharge lamp when said AC input terminals are energized by said source of AC power;

said inverter circuit comprising a single controllably conductive device and an inductor connected in series with one another and to said input terminals of said inverter circuit;

said output circuit comprising a resonant tank, whereby said electronic ballast draws a ballast input current from said source of AC power and said ballast input current total harmonic distortion is reduced below about 33.3%; and further including a valley fill circuit having input and output terminals; said input terminals of said valley fill circuit connected to said DC output terminals of said rectifying circuit.

19. The electronic ballast of claim 18 wherein the electronic ballast does not include a boost converter circuit.

20. An electronic ballast for driving at least one gas discharge lamp from a source of AC power which has a substantially sinusoidal line voltage at a given line frequency, comprising:

a rectifying circuit having AC input terminals and DC output terminals, said AC input terminals connectable to said source of AC power, said rectifying circuit producing a rectified output voltage at its said DC output terminals when said AC input terminals are energized by said source of AC power;

an inverter circuit having input terminals and output terminals; said input terminals of said inverter circuit connected to said output terminals of said rectifying circuit and said output terminals of said inverter circuit connectable to said at least one gas discharge lamp, and producing a high frequency drive voltage for driving a lamp current through said at least one gas discharge lamp when said AC input terminals are energized by said source of AC power;

said inverter circuit comprising a single controllably conductive device;

a control circuit coupled to said single controllably conductive device and operable to enable and disable conduction of said device for controllable lengths of time; said controllable lengths of time when conduction is enabled being reduced during a time around a time of a peak of an absolute value of said substantially sinusoidal line voltage whereby the current crest factor of said lamp current is reduced from that which would have occurred in the absence of said reduction of the controllable lengths of time when conduction is enabled, wherein said reduction of said controllable lengths of time when conduction is enabled is further selected to keep the ballast input current total harmonic distortion below about 33.3%.

21. The electronic ballast of claim 20 wherein said reduction of said controllable lengths of time when conduction is enabled is further selected to keep the ballast input current total harmonic distortion below about 20%.

22. The electronic ballast of claim 20 which further includes a valley fill circuit having input and output terminals; said input terminals of said valley fill circuit connected to said DC output terminals of said rectifying circuit.

23. The electronic ballast of claim 22, which further includes a cat ear circuit connected to said source of AC power; said cat ear circuit being adapted to conduct current for a first relatively short time following a first zero crossing of said line voltage and for a second relatively short time prior to a next zero crossing of said line voltage.

24. The electronic ballast of claim 20, which further includes a cat ear circuit connected to said source of AC power; said cat ear circuit being adapted to conduct current for a first relatively short time following a first zero crossing of said line voltage and for a second relatively short time prior to a next zero crossing of said line voltage.

25. The electronic ballast of claim 20, which further includes a cat ear circuit connected to said source of AC power; said cat ear circuit being adapted to conduct current for a first relatively short time following a first zero crossing of said line voltage and for a second relatively short time prior to a next zero crossing of said line voltage thereby to reduce the ballast input current total harmonic distortion from that which would exist in the absence of said cat ear circuit.

26. The electronic ballast of claim 25 whereby the ballast input current total harmonic distortion is reduced below about 20%.

27. The electronic ballast of claim 20 wherein said control circuit includes a microprocessor.

28. The electronic ballast of claim 20 wherein said control circuit includes a DSP.

29. The electronic ballast of claim 20 wherein said control circuit includes an ASIC.

30. An electronic ballast for driving at least one gas discharge lamp from a source of AC power which has a substantially sinusoidal line voltage at a given line frequency, comprising:

a rectifying circuit having AC input terminals and DC output terminals, said AC input terminals connectable to said source of AC power, said rectifying circuit producing a rectified output voltage at its said DC output terminals when said AC input terminals are energized by said source of AC power;

an inverter circuit having input terminals; said input terminals of said inverter circuit connected to said output terminals of said rectifying circuit;

an output circuit having input terminals and output terminals; said input terminals of said output circuit connected to said output terminals of said inverter circuit; and said output terminals of said output circuit connectable to said at least one gas discharge lamp; said inverter circuit producing a high frequency drive voltage for driving a lamp current through said at least one gas discharge lamp when said AC input terminals are energized by said source of AC power;

said inverter circuit comprising a single controllably conductive device and a first inductor connected in series with one another and to said input terminals of said inverter circuit;

said output circuit comprising a second inductor, whereby said electronic ballast draws a ballast input current from said source of AC power and said ballast input current total harmonic distortion is reduced below about 33.3%; and further including a valley fill circuit having input and output terminals; said input terminals of said valley fill circuit connected to said DC output terminals of said rectifying circuit.

31. The electronic ballast of claim 30 wherein the electronic ballast does not include a boost converter circuit.

32. The electronic ballast of claim 30 which further includes a cat ear circuit connected to said DC output terminals of said rectifying circuit, said cat ear circuit being adapted to conduct current for a first relatively short time following a first zero crossing of said line voltage and for a second relatively short time prior to a next zero crossing of said line voltage.

33. The electronic ballast of claim 30 further including a cat ear circuit connected to said source of AC power; said cat ear circuit being adapted to conduct current for a first relatively short time following a first zero crossing of said line voltage and for a second relatively short time prior to a next zero crossing of said line voltage thereby to reduce the ballast input current total harmonic distortion from that which would occur in the absence of said cat ear circuit.

34. The electronic ballast of claim 33 whereby the ballast input current total harmonic distortion is reduced below about 20%.

35. The electronic ballast of claim 30 further comprising:

a control circuit coupled to said single controllably conductive device and operable to enable and disable conduction of said device for controllable lengths of time; said controllable lengths of time when conduction is enabled being reduced during a time around a time of a peak of an absolute value of said substantially sinusoidal line voltage whereby the current crest factor of said lamp current is reduced from that which would have occurred in the absence of said reduction of the controllable lengths of time when conduction is enabled, wherein said reduction of said controllable lengths of time when conduction is enabled is further selected to maintain the ballast input current total harmonic distortion below about 33.3%.

36. An electronic ballast for driving at least one gas discharge lamp from a source of AC power which has a substantially sinusoidal line voltage at a given line frequency, comprising:

a rectifying circuit having AC input terminals and DC output terminals, said AC input terminals connectable to said source of AC power, said rectifying circuit producing a rectified output voltage at its said DC output terminals when said AC input terminals are energized by said source of AC power;

an inverter circuit having input terminals and output terminals; said input terminals of said inverter circuit connected to said output terminals of said rectifying circuit;

an output circuit having input terminals and output terminals; said input terminals of said output circuit connected to said output terminals of said inverter circuit; and said output terminals of said output circuit connectable to said at least one gas discharge lamp;

said inverter circuit producing a high frequency drive voltage for driving a lamp current through said at least one gas discharge lamp when said AC input terminals are energized by said source of AC power;

said inverter circuit comprising a single controllably conductive device and an inductor connected in series with one another and to said input terminals of said inverter circuit;

said output circuit comprising a resonant tank, whereby said electronic ballast draws a ballast input current from said source of AC power and said ballast input current total harmonic distortion is reduced below about 33.3%; and further including a valley fill circuit having input and output terminals; said input terminals of said valley fill circuit connected to said DC output terminals of said rectifying circuit;

and further including a cat ear circuit connected to said source of AC power; said cat ear circuit being adapted to conduct current for a first relatively short time following a first zero crossing of said line voltage and for a second relatively short time prior to a next zero crossing of said line voltage.

37. An electronic ballast for driving at least one gas discharge lamp from a source of AC power which has a substantially sinusoidal line voltage at a given line frequency, comprising:

a rectifying circuit having AC input terminals and DC output terminals, said AC input terminals connectable to said source of AC power, said rectifying circuit producing a rectified output voltage at its said DC output terminals when said AC input terminals are energized by said source of AC power;

an inverter circuit having input terminals and output terminals; said input terminals of said inverter circuit connected to said output terminals of said rectifying circuit; an output circuit having input terminals and output terminals; said input terminals of said output circuit connected to said output terminals of said inverter circuit; and said output terminals of said output circuit connectable to said at least one gas discharge lamp;

said inverter circuit producing a high frequency drive voltage for driving a lamp current through said at least one gas discharge lamp when said AC input terminals are energized by said source of AC power;

said inverter circuit comprising a single controllably conductive device and an inductor connected in series with one another and to said input terminals of said inverter circuit;

said output circuit comprising a resonant tank, whereby said electronic ballast draws a ballast input current from said source of AC power and said ballast input current total harmonic distortion is reduced below about 33.3%; and further including a valley fill circuit having input and output terminals; said input terminals of said valley fill circuit connected to said DC output terminals of said rectifying circuit;

and further including a cat ear circuit connected to said source of AC power; said cat ear circuit being adapted to conduct current for a first relatively short time following a first zero crossing of said line voltage and for a second relatively short time prior to a next zero crossing of said line voltage thereby to reduce the ballast input current total harmonic distortion from that which would exist in the absence of said cat ear circuit.

38. The electronic ballast of claim 37 whereby the ballast input current total harmonic distortion is reduced below about 20%.

39. An electronic ballast for driving at least one gas discharge lamp from a source of AC power which has a substantially sinusoidal line voltage at a given line frequency, comprising:

a rectifying circuit having AC input terminals and DC output terminals, said AC input terminals connectable to said source of AC power, said rectifying circuit producing a rectified output voltage at its said DC output terminals when said AC input terminals are energized by said source of AC power;

an inverter circuit having input terminals and output terminals; said input terminals of said inverter circuit connected to said output terminals of said rectifying circuit; an output circuit having input terminals and output terminals; said input terminals of said output circuit connected to said output terminals of said inverter circuit; and said output terminals of said output circuit connectable to said at least one gas discharge lamp;

said inverter circuit producing a high frequency drive voltage for driving a lamp current through said at least one gas discharge lamp when said AC input terminals are energized by said source of AC power;

said inverter circuit comprising a single controllably conductive device and an inductor connected in series with one another and to said input terminals of said inverter circuit;

said output circuit comprising a resonant tank, whereby said electronic ballast draws a ballast input current from said source of AC power and said ballast input current total harmonic distortion is reduced below about 33.3%; and further including a valley fill circuit having input and output terminals; said input terminals of said valley fill circuit connected to said DC output terminals of said rectifying circuit;

further comprising:

a control circuit coupled to said single controllably conductive device and operable to enable and disable conduction of said device for controllable lengths of time; said controllable lengths of time when conduction is enabled being reduced during a time around a time of a peak of an absolute value of said substantially sinusoidal line voltage whereby the current crest factor of said lamp current is reduced from that which would have occurred in the absence of said reduction of the controllable lengths of time when conduction is enabled, wherein said reduction of said controllable lengths of time when conduction is enabled is further selected to maintain the ballast input current total harmonic distortion below about 33.3%.

40. In an electronic ballast for driving at least one gas discharge lamp from a source of AC power which has a substantially sinusoidal line voltage at a given line frequency; the method of reducing the ballast input current total harmonic distortion below about 33.3% and of reducing lamp current crest factor below about 2.1, comprising the steps of:

a) rectifying said substantially sinusoidal line voltage from said source of AC power to provide a rectified voltage;

b) producing a DC voltage that is a predetermined percentage of a peak of said rectified voltage;

c) modifying the rectified voltage by supplying said DC voltage between peaks of the rectified voltage to provide a valley filled voltage; and d) inverting the valley filled voltage in an inverter circuit with a single controllably conductive device to provide a lamp current to drive said at least one gas discharge lamp.

41. The method of claim 40 wherein the step of rectifying comprises providing a full wave rectified voltage.

42. The method of claim 40, which includes the further steps of; drawing additional current through a cat ear circuit from said source of AC power during a first time interval following a line voltage zero crossing and a second time interval just prior to a next line voltage zero crossing thereby to reduce said ballast input current total harmonic distortion to below about 20%.

43. In an electronic ballast for driving at least one gas discharge lamp from a source of AC power which has a substantially sinusoidal line voltage at a given line frequency; a method for setting a voltage on an energy storage capacitor of a valley fill circuit in said electronic ballast, comprising the steps of:

a) rectifying said substantially sinusoidal line voltage from said source of AC power to provide a rectified voltage;

b) inverting said rectified voltage in an inverter circuit to provide a tamp current to drive said at least one gas discharge lamp;

c) applying a charging current to said energy storage capacitor of said valley fill circuit solely from a winding in said inverter circuit to charge said energy storage capacitor to a predetermined voltage level; and d) constraining the voltage on said controllably conductive device to be limited to a predetermined multiple of said rectified voltage when said device is non-conducting by diverting a portion of said energy stored in the inductor into a voltage source.

44. The method of claim 43 wherein the step of rectifying comprises providing a full wave rectified voltage.

45. In an electronic ballast for driving at least one gas discharge lamp from a source of AC power which has a substantially sinusoidal line voltage at a given line frequency; a method for constraining a voltage on a controllably conductive device in a single switch inverter of said electronic ballast, said method comprising the steps of:

a) rectifying said substantially sinusoidal line voltage from said source of AC power to provide a rectified voltage;

b) inverting said rectified voltage to drive a current through said at least one gas discharge lamp and storing energy in an inductor by applying said rectified voltage to said inductor under the control of said conductive controllably conductive device, and;

c) constraining the voltage on said controllably conductive device to be limited to a predetermined multiple of said rectified voltage when said device is non-conducting by diverting a portion of said energy stored in the inductor into a voltage source.

46. The method of claim 45 wherein the step of rectifying comprises providing a full wave rectified voltage.

47. In an electronic ballast for driving at least one gas discharge lamp from a source of AC power which has a substantially sinusoidal line voltage at a given line frequency; a method for recharging an energy storage capacitor in a valley fill circuit of said ballast; said method comprising the steps of:

a) rectifying said substantially sinusoidal line voltage from said source of AC power to provide a rectified voltage;

b) inverting said rectified voltage to drive a current through said at least one gas discharge lamp and storing energy in an inductor by applying said rectified voltage to said inductor under the control of a conductive controllably conductive device, and;

c) constraining the voltage on said controllably conductive device to a predetermined level when said controllably conductive device is non-conductive, by diverting a portion of said energy stored in the inductor through a winding into said energy storage capacitor of said valley fill circuit, wherein said energy diverted through said winding is the only energy which charges said energy storage capacitor of said valley fill circuit.

48. The method of claim 47 wherein the step of rectifying comprises providing a full wave rectified voltage.

49. In an electronic ballast for driving at least one gas discharge lamp from a source of AC power which has a substantially sinusoidal line voltage at a given line frequency, a method for reducing a current crest factor of a lamp current provided by said electronic ballast and maintaining the ballast input current total harmonic distortion at or below about 33.3% comprising the steps of:

a) rectifying said substantially sinusoidal line voltage from said source of AC power to provide a rectified voltage;

b) inverting said rectified voltage in an inverter circuit having a single controllably conductive device to provide the lamp current to said at least one gas discharge lamp;

c) reducing the conduction time of said single controllably conductive device during a time around a time of a peak of an absolute value of said substantially sinusoidal line voltage to reduce the value of the current crest factor of said lamp current of said at least one gas discharge lamp below a predetermined value; and d) restricting the reduction of conduction time of said single controllably conductive device so that the ballast input current total harmonic distortion is maintained at or below about 33.3%.

50. The method of claim 49 wherein the step of rectifying comprises providing a full wave rectified voltage.

51. The method of claim 49 whereby said predetermined value is reduced to below about 2.1 by selecting said reduction of said conduction time of said single controllably conductive device.

52. The method of claim 49 whereby said predetermined value is reduced to below about 1.7 by selecting said reduction of said conduction time of said single controllably conductive device.

53. An electronic ballast for driving at least one gas discharge lamp from a source of AC power which has a substantially sinusoidal line voltage at a given line frequency, comprising:

a rectifying circuit having AC input terminals and DC output terminals, said AC input terminals connectable to said source of AC power, said rectifying circuit producing a rectified output voltage at its said DC output terminals when said AC input terminals are energized by said source of AC power;

an inverter circuit comprising a single controllably conductive device having input terminals connected to said output terminals of said rectifying circuit; the inverter circuit including an inductive device coupled to a primary energy storage device;

wherein said electronic ballast input current in-rush is limited by the operation of the single controllably conductive device whereby when the single controllably conductive device becomes nonconductive, a voltage is developed across the inductive device to limit the in-rush current flowing into the primary energy storage device with the inductive device providing the only current for recharging said primary energy storage device.

54. The electronic ballast of claim 53 wherein said inherently limited ballast input current in-rush is less than about 7 amperes.

55. The electronic ballast of claim 53, wherein said inherently limited ballast input current in-rush is less than about 3 amperes.

56. An electronic ballast for driving at least one gas discharge lamp from a source of AC power which has a substantially sinusoidal line voltage at a given line frequency, comprising:

a rectifying circuit having AC input terminals and DC output terminals, said AC input terminals connectable to said source of AC power, said rectifying circuit producing a rectified output voltage at its said DC output terminals when said AC input terminals are energized by said source of AC power;

an inverter circuit comprising a single controllably conductive device having input terminals connected to said output terminals of said rectifying circuit;

wherein said electronic ballast input current in-rush is limited by the operation of the single controllably conductive device;

wherein said electronic ballast input current in-rush is limited by providing in said inverter circuit an inductance coupled across the input terminals of said inverter circuit, said inductance including a tap, said tap coupled to charge a primary energy storage capacitor of the electronic ballast.

* * * * *